US005337588A

United States Patent [19]

Chhatwal

[11] Patent Number: 5,337,588

[45] Date of Patent: Aug. 16, 1994

[54] ELECTRONIC LOCK AND KEY SYSTEM

[75] Inventor: Kn S. Chhatwal, West Melbourne, Fla.

[73] Assignee: Intellikey Corporation, Melbourne, Fla.

[21] Appl. No.: 596,210

[22] Filed: Oct. 11, 1990

[51] Int. Cl.[5] ..... E05B 49/02

[52] U.S. Cl. ..... 70/278; 70/283; 70/372; 70/380; 70/408; 70/431; 76/110; 264/264; 264/272.14; 264/272.15; 264/272.17; 307/10.2; 340/825.31; 361/172

[58] Field of Search ..... 70/276, 277, 278, 283, 70/372, 380, 395, 408, 413, 431, 447; 76/110; 264/264, 272.14, 272.15, 272.17; 307/10.2; 340/825.31; 361/172

[56] References Cited

U.S. PATENT DOCUMENTS

| | | | |
|---|---|---|---|
| Re. 29,259 | 6/1977 | Sabsay | 340/149 A |
| 1,059,759 | 4/1913 | Preston | 70/413 |
| 3,688,269 | 8/1972 | Miller | 340/149 R |
| 3,806,874 | 4/1974 | Ehrat | 340/149 R |
| 4,079,356 | 3/1978 | Anagnost et al. | 340/149 A |
| 4,297,863 | 11/1981 | Glock | 70/408 X |
| 4,298,792 | 11/1981 | Granholm et al. | 235/372 |
| 4,322,719 | 3/1982 | Moorhouse | 235/382 |
| 4,415,893 | 11/1983 | Roland et al. | 340/825.31 |
| 4,509,093 | 4/1985 | Stellberger | 361/172 |
| 4,562,712 | 1/1986 | Wolter | 70/456 R |
| 4,593,185 | 6/1986 | Patzelt et al. | 235/382 |
| 4,603,564 | 8/1986 | Kleinhäny et al. | 70/277 |
| 4,633,687 | 1/1987 | Fane | 70/413 X |
| 4,642,734 | 2/1987 | Anderson | 361/380 |
| 4,663,952 | 5/1987 | Gelhard | 70/278 |
| 4,726,205 | 2/1988 | Allerdist et al. | 70/395 |
| 4,766,746 | 8/1988 | Henderson | 70/63 |
| 4,789,859 | 12/1988 | Clarkson et al. | 70/278 X |
| 4,800,590 | 1/1989 | Vaughan | 380/25 |
| 4,849,749 | 7/1989 | Fukamachi et al. | 70/278 X |
| 4,858,453 | 8/1989 | Namazue | 70/278 |
| 4,866,962 | 9/1989 | Aston et al. | 70/277 |
| 4,868,409 | 9/1989 | Tanaka et al. | 70/278 X |
| 4,922,736 | 5/1990 | Tanaka et al. | 70/277 |
| 4,944,908 | 7/1990 | Leveque et al. | 264/272.15 X |
| 4,947,662 | 8/1990 | Imedio | 70/408 X |
| 4,964,023 | 10/1990 | Nishizawa et al. | 70/277 X |
| 4,965,460 | 10/1990 | Tanaka et al. | 307/10.2 |

FOREIGN PATENT DOCUMENTS

| | | | |
|---|---|---|---|
| 3006128 | 8/1981 | Fed. Rep. of Germany | 70/278 |
| 2610778 | 8/1988 | France | 70/278 |
| WO83/00976 | 3/1983 | PCT Int'l Appl. | 70/277 |
| 2024922 | 1/1980 | United Kingdom | 70/277 |

*Primary Examiner*—Lloyd A. Gall
*Attorney, Agent, or Firm*—Charles Wands

[57] ABSTRACT

An electronic key and lock system, particularly useful for solenoid-operated locks employs a key that can operate electronically and mechanically. The key is mechanically polarized with its blade forming a first electrical contact and a separate second contact which is flush or raised relative to the blade. Each of the key and the cylinder employs respective light emitting and light receiving IR devices for communications between the electronics in the key and communications within the lock. The lock includes a solenoid-operated electronic cylinder.

36 Claims, 19 Drawing Sheets

ELECTRONIC LOCK AND KEY SYSTEM

CROSS-REFERENCE TO RELATED APPLICATION

This application is related to an application entitled ELECTRONIC LOCK AND KEY SYSTEM, Ser. No. 596,100, filed Oct. 11, 1990 in the name of Dr. Christopher W. Malinowski, et al., now abandoned and the contents of which are incorporated by reference herein to the extent necessary.

BACKGROUND AND SUMMARY OF THE INVENTION

The present invention relates to a new electronic key and cylinder system and method and, more particularly, to a system and method which can be employed with standard mortise locks and cylinder locks. An electronic key which incorporates electronics and IR devices for communicating with lock electronics for authorization and access to actuate the lock are provided in a moisture impervious housing on the key.

A major problem which results in thefts is that doors are left unlocked, and unauthorized duplicates and copies of duplicates of master keys are in the hands of many people which allows quick entry to and access from rooms and buildings. The degree of key control is limited by the type of cylinders and keys used. Any new keying system must include key control. Sophisticated lock cylinders are believed to have advantages because they cannot be readily compromised by the use of standard key blanks available to any professional locksmith or even a hardware store.

Solutions to date have included products with an interchangeable core or conventional cylinders with restricted keyways, mechanical high-security lock cylinders and electronically reprogrammable access control system using keys or cards. The latter have been used in connection, for example, with electronic products such as radar warning devices to limit access to the rightful owner. Cincinnati Microwave offers such a "Digital Key" feature in connection with its "ESCORT" and "SOLO"-brand radar detectors.

Electronic key locks are generally known as shown in U.S. Pat. No. 3,688,269, in which a key blade has an array of holes and non-holes, with each row of holes representing a coded word. The key is inserted into a key reader, and if the proper key is inserted, an ACCEPT output will be produced at a terminal which can be used to operate a lock mechanism. Such a key cannot be reprogrammed and has the disadvantage of its digital code being at the exposed blade which is subject to damage, bending or the like. Furthermore, although the number of available digital codes is substantial, nevertheless the number is not as high as desirable to reduce the possibility of duplicating the key by an unauthorized user.

U.S. Pat. No. 4,298,792 discloses another type of a digitally coded data carrier in the form of a key which carries the data on a non-mechanical coded track. A lock contains sensors which interact with the coded track without contact to generate an output signal which is fed to a memory that contains the correct information for unlocking the system, thereby providing different code permutations which are several orders of magnitude higher than lock and tumbler systems. The coded track is intended to be invisible to the human eye and transparent to infrared radiation. A disadvantage of such an arrangement, however, is that the key cannot be reprogrammed remotely to provide a new access code.

Key devices which incorporate an electronic circuit for use with a vehicle mechanical lock are known as shown in U.S. Pat. No. 4,922,736. The knob or rear portion which contains the circuit comprises two halves made of a synthetic resin material and joined together with a bonding agent, a snap engagement or the like. Light emitting diodes are provided on both sides of the key blade. A power source is provided on one side of the circuit board located in the knob portion, as well as a push button switch which is necessary to activate the code transmission circuit. Separate contacts for electrically connecting the circuit of the key with the vehicle engine control circuit are provided on each side of the key. The manufacture of this key is made more expensive and complicated by the need to produce two knob halves and then join them together with a sufficient seal. In this connection, the protection of the electronic circuit from the harmful effects of moisture cannot be positively assured due to the interface along the entire periphery of the knob. Due to the contact design at the sides of the key blade, a special key design is required which precludes the use of this device with standard door and cabinet locks. The requirement to have two separate contacts also makes the design unnecessarily complicated and expensive to produce. In addition, the system with which this key is used requires battery cells and a push-button switch within the knob itself which must be pressed which the key itself is being turned in order to obtain a coded light signal from the LEDs in the knob.

Another type of coded key is shown in U.S. Pat. No. 4,593,185 which uses a standard door key or card on which a layer is burned by a laser beam to code with fine, discrete depressions which are subsequently read by a unit which contains the correct coding information and decides if the user is authorized to gain access. Although this is a relatively simple approach, the coding of the key is fixed and this does not provide the flexibility achieved with codings which can be changed. Thus, new keys must be produced and provided each time the coding of a lock is changed. Moreover, the coded portions of the key are at the exposed key blade where the fine depressions are subject to wear and damage which may prevent actuation of the lock if the memory unit cannot read the code.

Another type of electronic locking system having a reprogrammable key is described in U.S. Pat. No. 4,789,859 for use with a mortise lock. Electronic logic circuitry is provided with the mortise lock cylinder to recognize the full insertion of the key and extract encoded information from the key memory located in the exposed key blade. The logic circuitry in the cylinder can alter the codes in the key memory based on data transmitted from the cylinder, and can alter codes stored in the cylinder based upon data from the key memory. A key centering and retention device can be provided in the cylinder to interact with a notch on the key to ensure the proper location of the key within the keyway.

A security door system which incorporates electronics in the knob of a dimpled "smart key" for operating a deadbolt is offered under the "KABA NOVA" trademark of Lori Corporation. It is designed to install quickly on conventional doors without hardwiring in order to minimize installation costs and materials. Lost keys can be invalidated quickly without the costs of cutting and distributing new keys. The keys can be reprogrammed indefinitely with the need for cutting each time system designs or authorizations are changed and can be used not only as an electronic key, but also as a mechanical key. The electronic intelligence can be programmed to limit access by location and even by time window. A time/calendar module decides when to open or remain locked. A programming unit is designed to determine not only who is allowed to open a certain door, but also to find out who most recently did. A problem with this approach, however, is that the leads to the electronic circuit inside the knob are exposed and can very easily be damaged. In addition, the knob is comprised of two halves which must be joined together and sealed to prevent moisture intrusion and damage to the electronic circuit.

Various other types of coded keys are known, for example, U.S. Pat. No. 4,663,952 shows a key having a microprocessor in a recess in the key handle connected with an opto-electronic component for photo-electric transmission for signal currents and a miniature shell core half for output currents. U.S. Pat. No. 4,726,205 shows a vehicle ignition key which has transmitter electronics in a two-part handle which is Joined by dovetail guides. These and similar arrangements have substantial disadvantages in the key construction and in the flexibility of the key-lock system.

An object of the present invention is to provide a simple yet effective intelligent key-lock system which is usable in a variety of locks and further avoids the need to replace standard lock components.

Another object of the present invention is to utilize a method for producing a key which is less expensive than conventional key assembly methods and yet produces a superior key which is moisture-proof.

A further object of the present invention is to produce a key with the minimum number of components to reduce costs and, at the same time, provide a key configuration which allows usage as both an electronic key and a mechanical key.

A still further object of the present invention is to provide an electronic key whose sensitive components are completely covered by a plastic housing to prevent damage thereto.

Yet another object of the present invention is the provision of an electronic cylinder which is easily assembled with substantially snap fittings to minimize the need for more expensive operations, such as soldering, and which allows the use of plastic parts in the cylinder.

A still further object of the present invention is the ability to use the intelligent key lock system in a standard, mechanical lock in which the cylinder accommodates the necessary parts so as to avoid the need to dismantle an existing mechanical lock.

Another object of the present invention is to allow the use of an external power source in a simple manner to power the system in the event of failure of the system power source.

The foregoing and other objects have been achieved in accordance with the present invention by the use of a system in which the key is powered externally from a lock mechanism through a metallic/insulator layer layout of the key blade when the key is inserted in the lock mechanism. Communications between control circuitry within the key itself and the circuitry within the lock are carried out by respective IR diode and optical detector units in the key and lock. The lock mechanism on, for example, a door contains a battery, a microprocessor and associated memory, and an external communication port for effecting communications with a remote supervisory terminal/storage facility. Precursor verification codes are necessary before the lock mechanism (e.g., a solenoid) will respond to key insertion.

The key of the present invention consists of a blade, a knob portion on which a PCB is laid, and a one-piece molded plastic housing surrounding the PCB in a moisture-proof manner. The blade acts as one of the contacts, and a positive contact separated from the blade by an insulator seat extends from the PCB through the housing along a portion of the key blade. The key can be configured to be used only as an electronic key or as both an electronic and mechanical key. The positive contact can be flush with the surface of the key blade or raised therefrom so as to require a keyway with a matching profile and thereby provide a "mechanical polarization" which permits insertion of the key in only one orientation. The molded housing surrounding the PCB also serves to Join and secure the positive contact and insulator seat to the blade. The housing also can be provided with a notched portion for allowing the use of an external power unit in the event the system power supply fails, e.g., a battery.

The method of molding the housing in one-piece avoids the need for and expense of two separate housing parts and also the manufacturing process of sealing the two halves together. The plastic injection molding method of the present invention utilizes a two-part mold which defines the housing configuration and a slide which locates two IR devices in their precise desired location relative to the key blade and protects those devices during the molding operation by creating a cavity around the devices which can subsequently be filled with a protective coating or IR sensitive plastic lenses.

The cylinder according to one embodiment of the present invention includes leaf-spring contact arms which are snap-fitted into a plastic housing. The contact arms for the positive and negative contact have the same configuration, but, when a flush positive contact key is used, a rider pin can be inserted in the contact arm associated with the positive contact to prevent that contact arm from coming into contact with the key blade until the positive contact is aligned with the contact portion of that contact arm and the rider pin is dropped into a blind hole on the key blade. The IR devices and leads can also be snap-fitted into the housing to minimize the need for soldering connections to the contact arms and the IR devices. A low-battery warning light can also be provided in the cylinders to alert the system user to imminent failure of the system power supply.

According to another embodiment of the present invention used in a standard mechanical lock, an electronic cylinder can replace the innards of the mechanical lock without requiring the lock to be dismantled. To this end, the electronic cylinder portion which is inserted in the standard cylinder body comprises a solenoid housing, fixed and moving contacts, wiring, pin assembly, channel for the wiring, a spring loaded cam locator, a moving keyway cylinder, and the IR devices as one complete assembly in which the key must be inserted to rotate the keyway cylinder and can only be withdrawn from that cylinder in a particular orientation, e.g., a vertical position of the key.

Where compactness is particularly desired, the lock electronics can be located in the lock rose instead of in a separate enclosure attached to the inside of the door.

BRIEF DESCRIPTION OF THE DRAWINGS

These and other objects, features and advantages of the present invention will become more apparent from the following detailed description of presently preferred embodiments when taken in conjunction with the accompanying drawings wherein.

Figure 1:
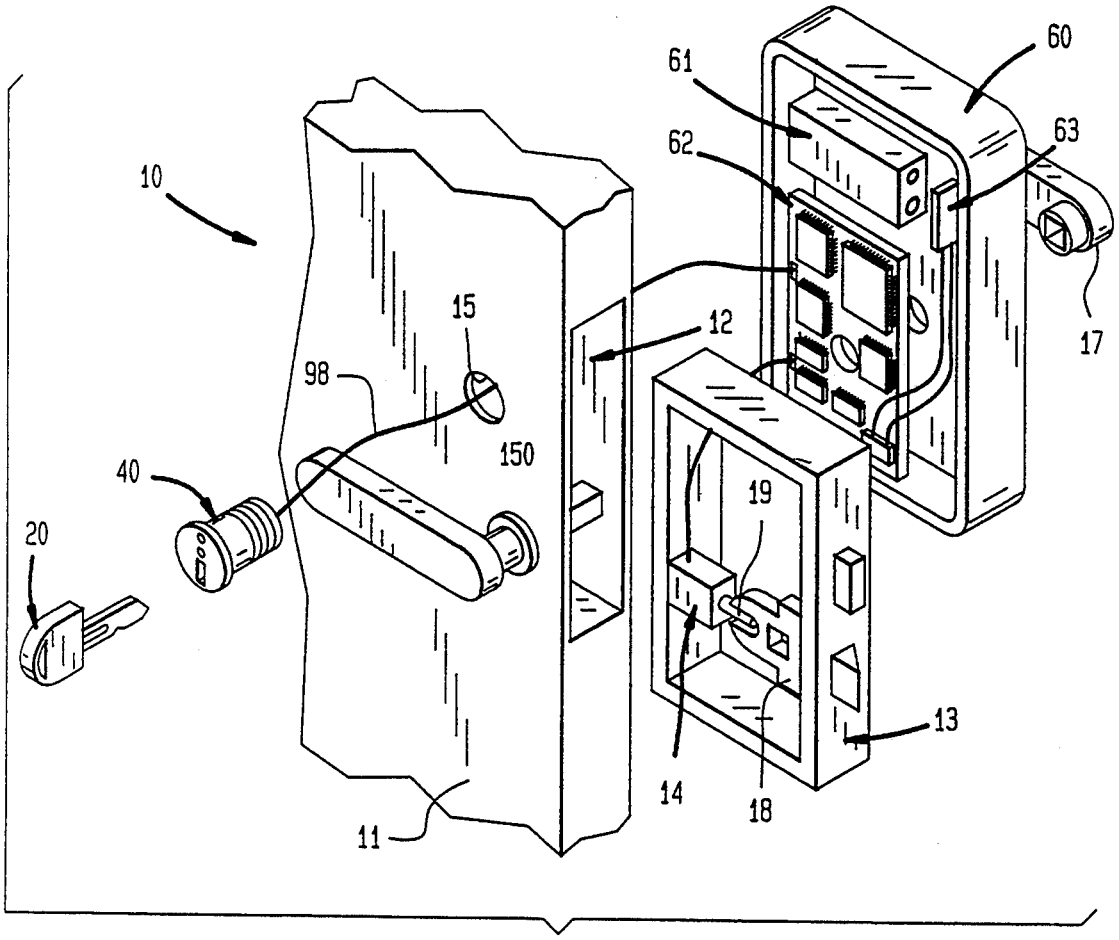
FIG. 1 is an exploded perspective view of the electronic key and cylinder system used with a mortise lock for a door.
Figure 6A:
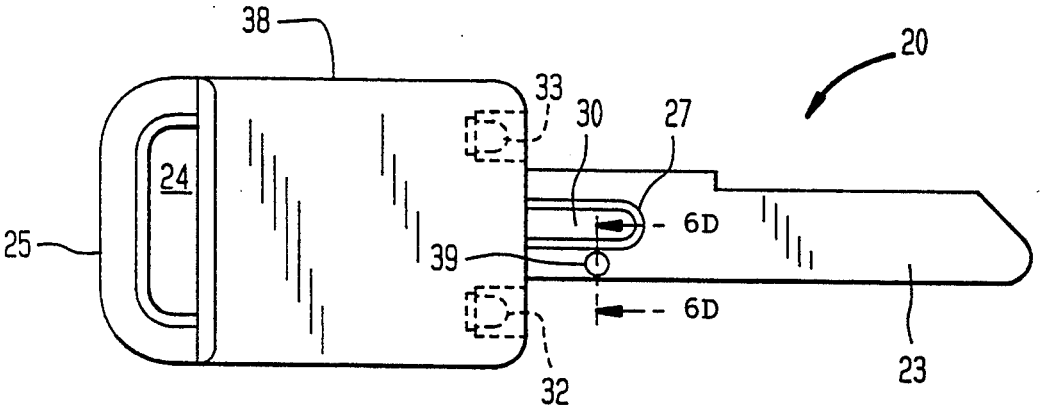
FIGS. 6A–6C are, respectively, front elevational, back elevational and front end views of the fully finished electronic key shown in FIGS. 5A and 5B.
Figure 6B:
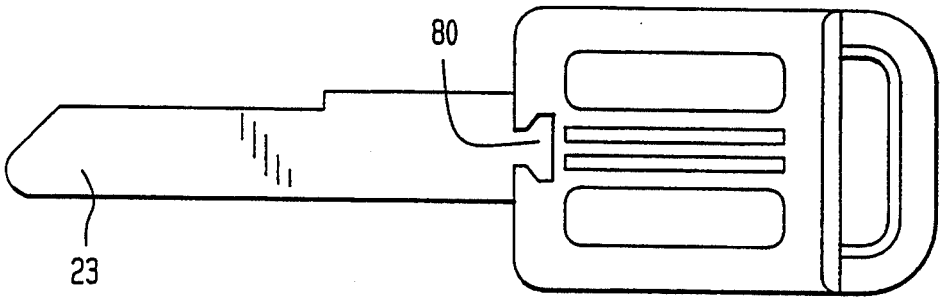
Figure 6C:
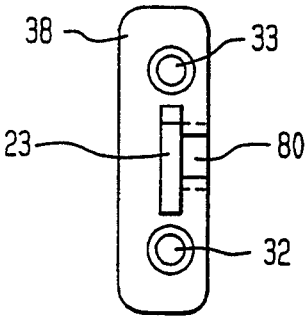
Figure 7A:
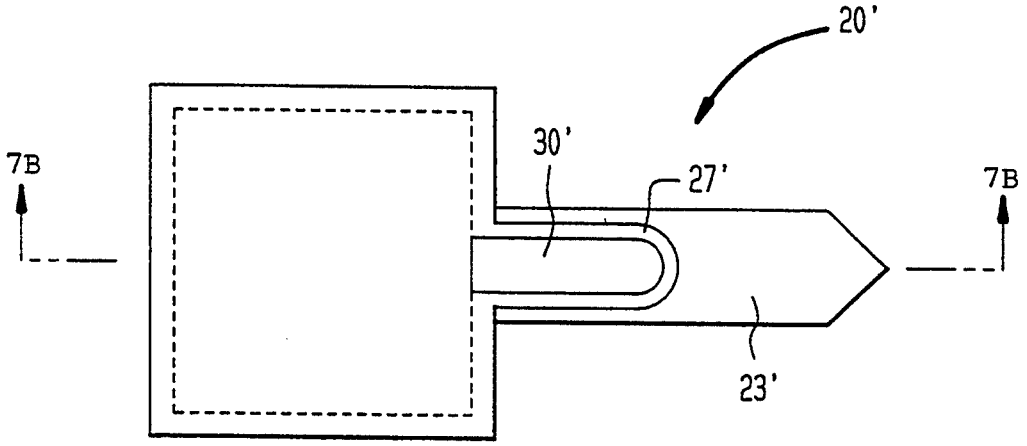
Figure 7B:
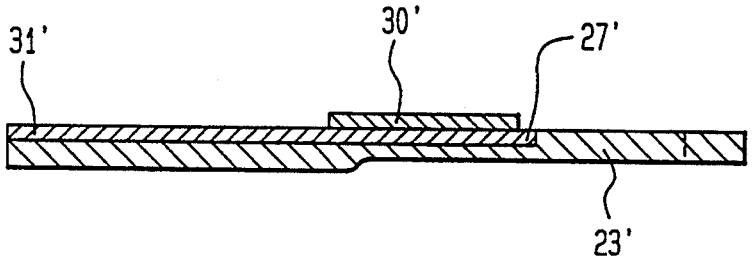
Figure 8:
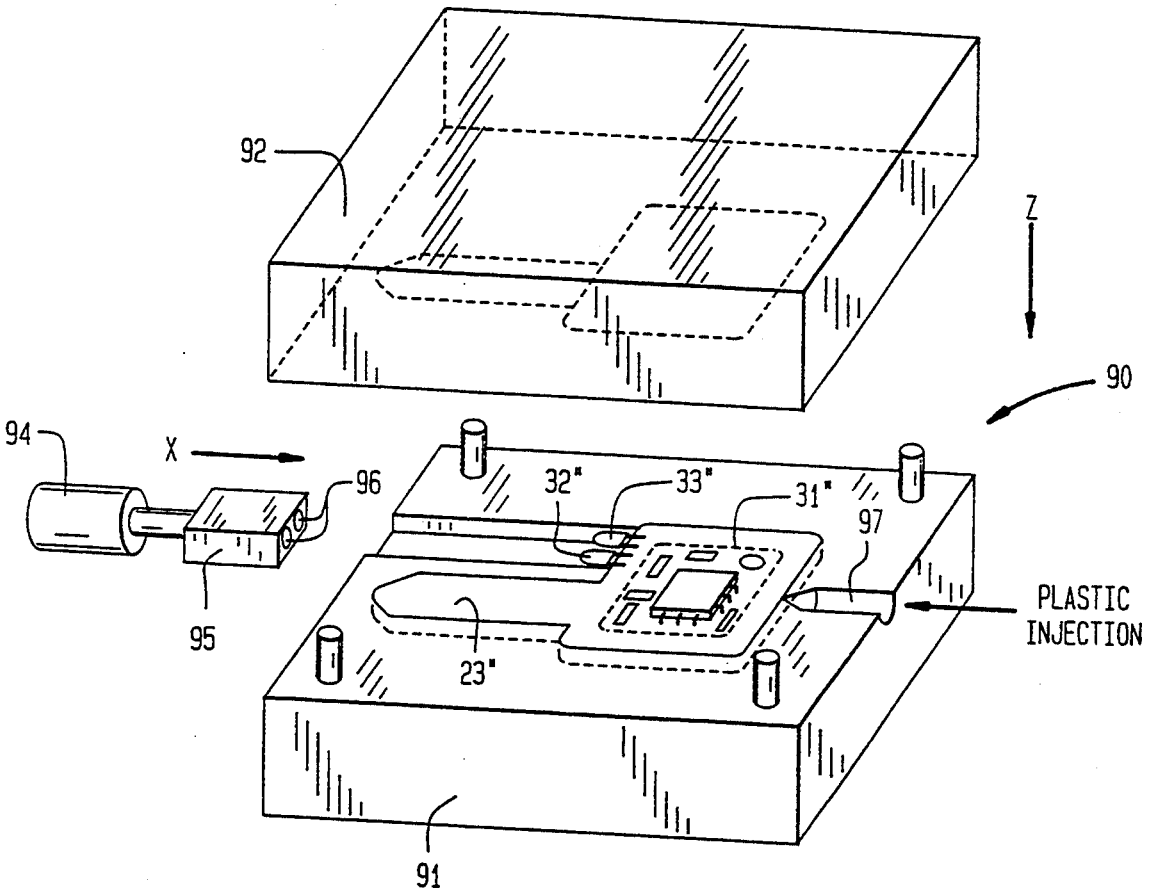
Figure 9B:
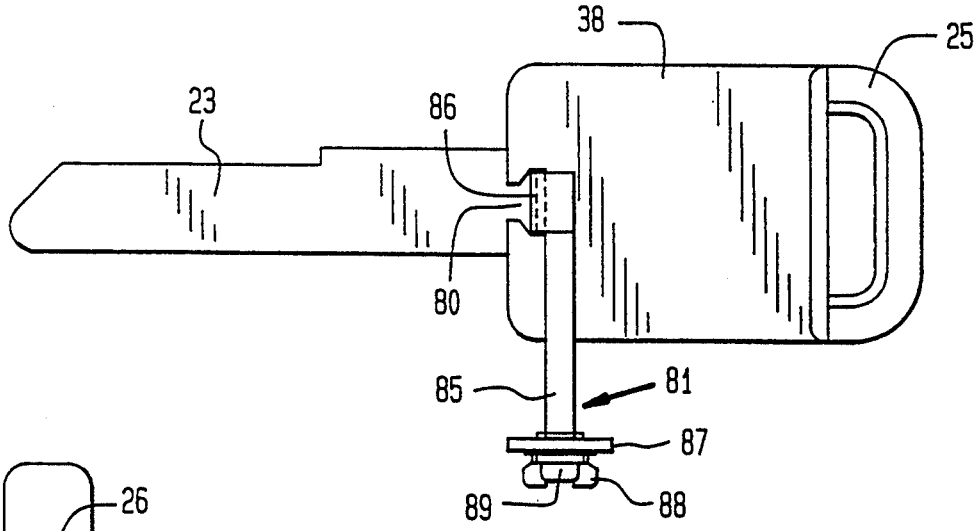
Figure 9A:
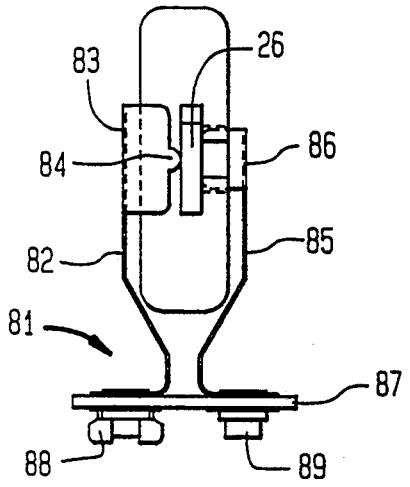
Figure 18A:
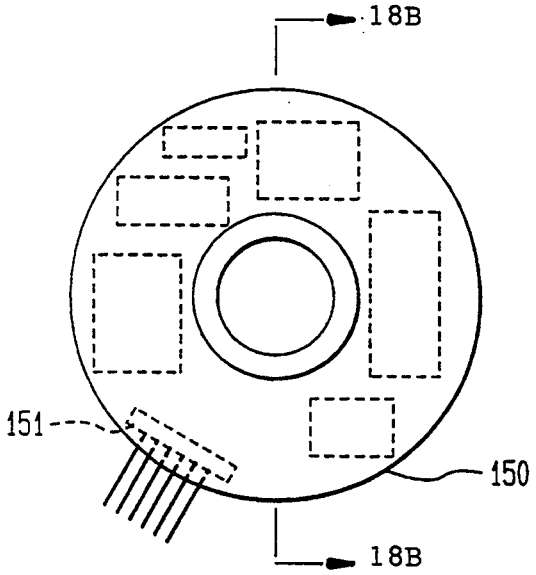
Figure 18B:
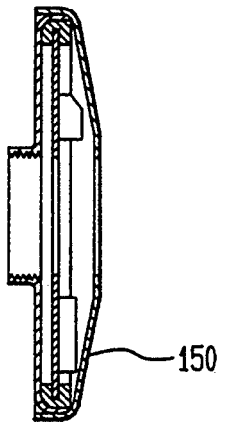
Figure 10A:
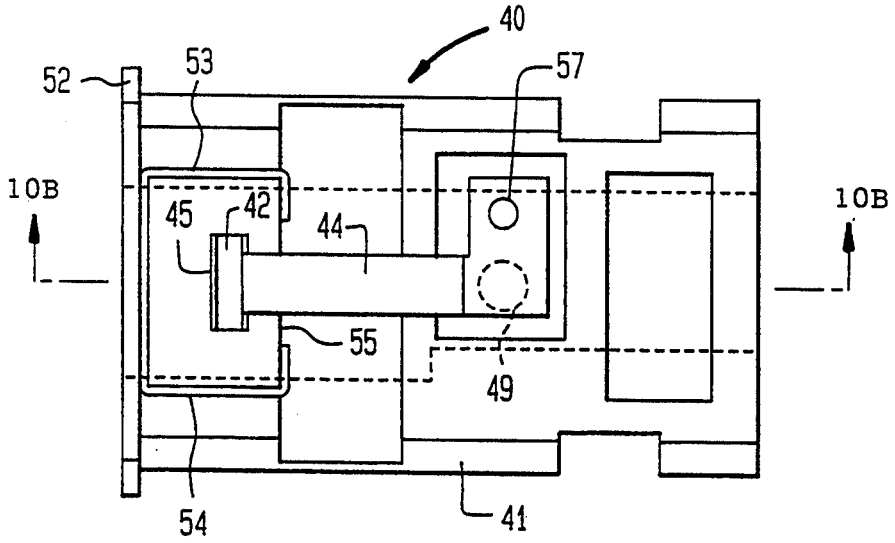
Figure 10B:
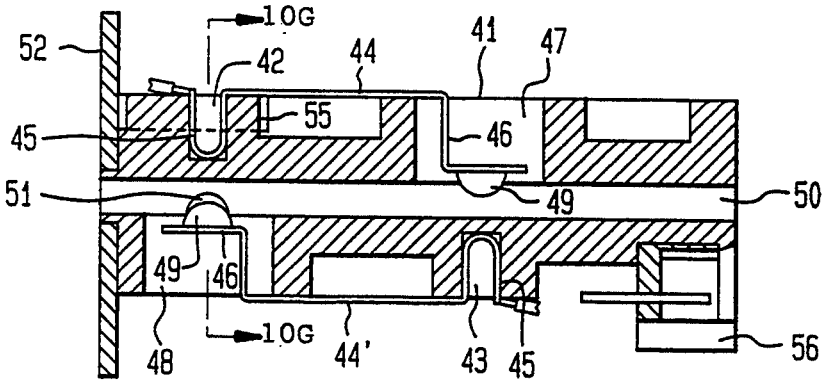
Figure 10C:
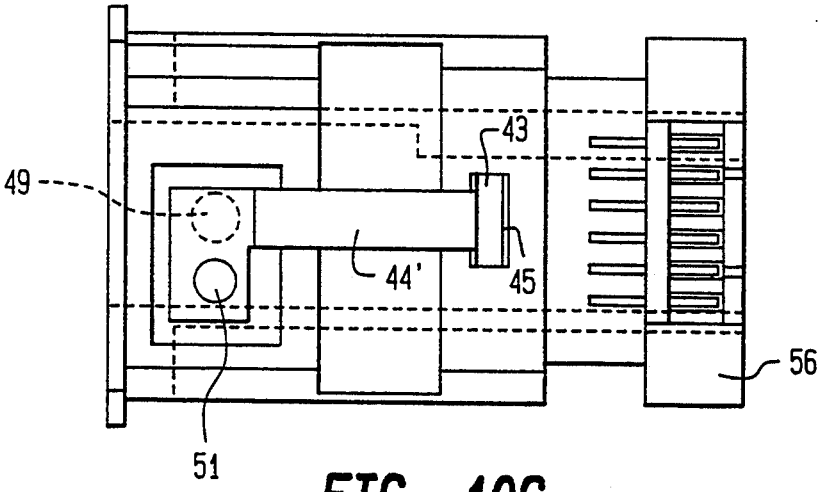
Figure 10D:
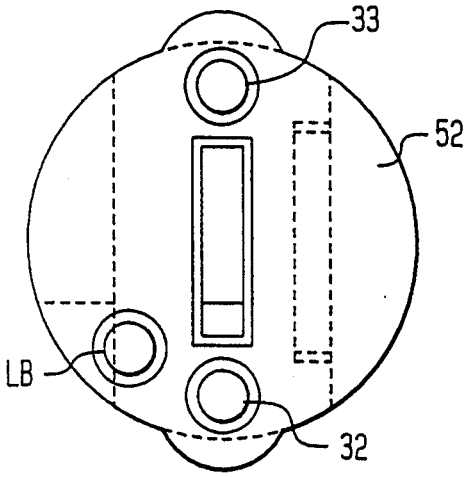
Figure 10E:
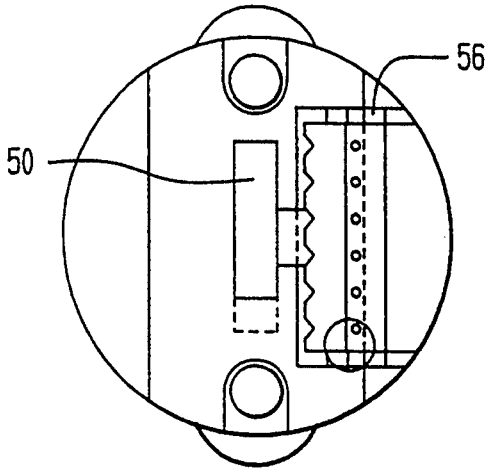
Figure 10F:
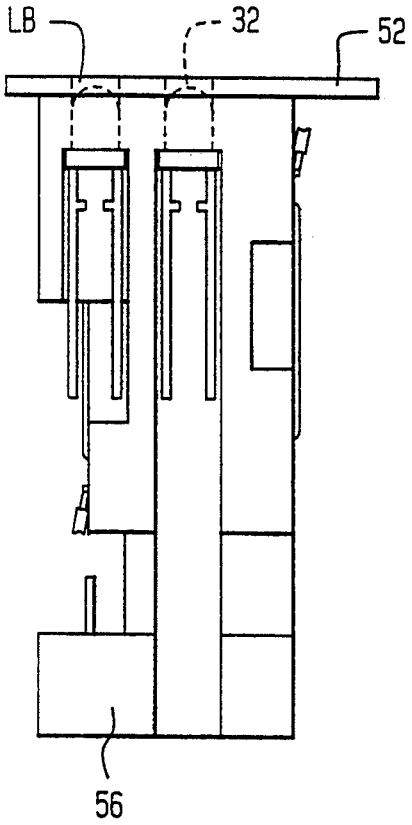
Figure 10G:
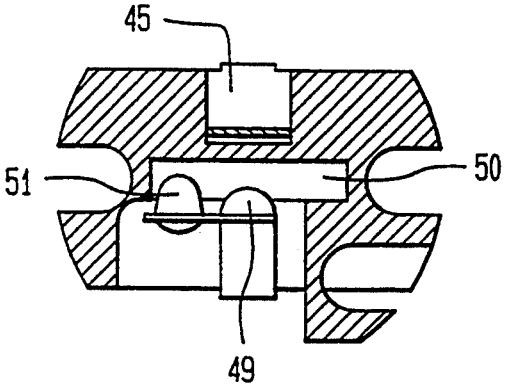
Figure 11A:
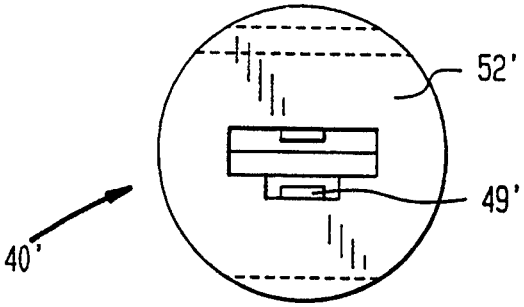
Figure 11C:
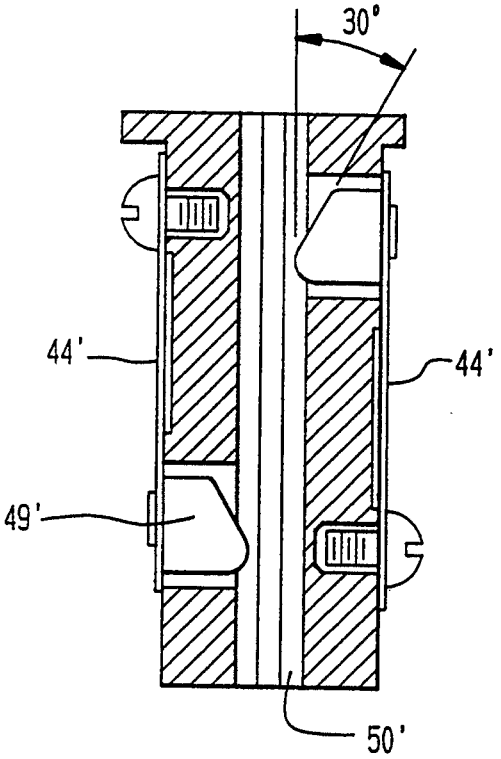
Figure 11B:
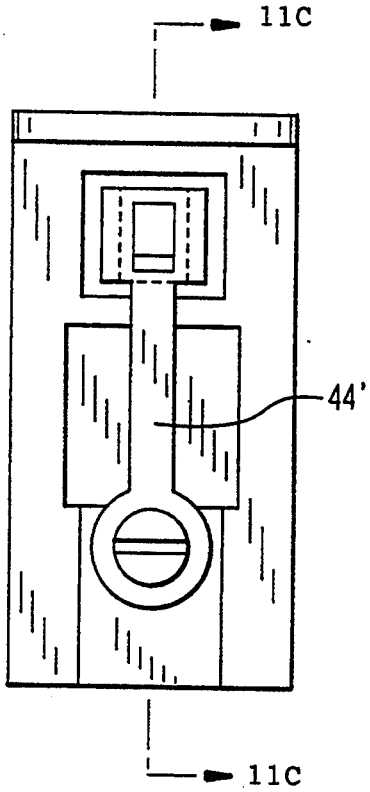
Figure 12B:
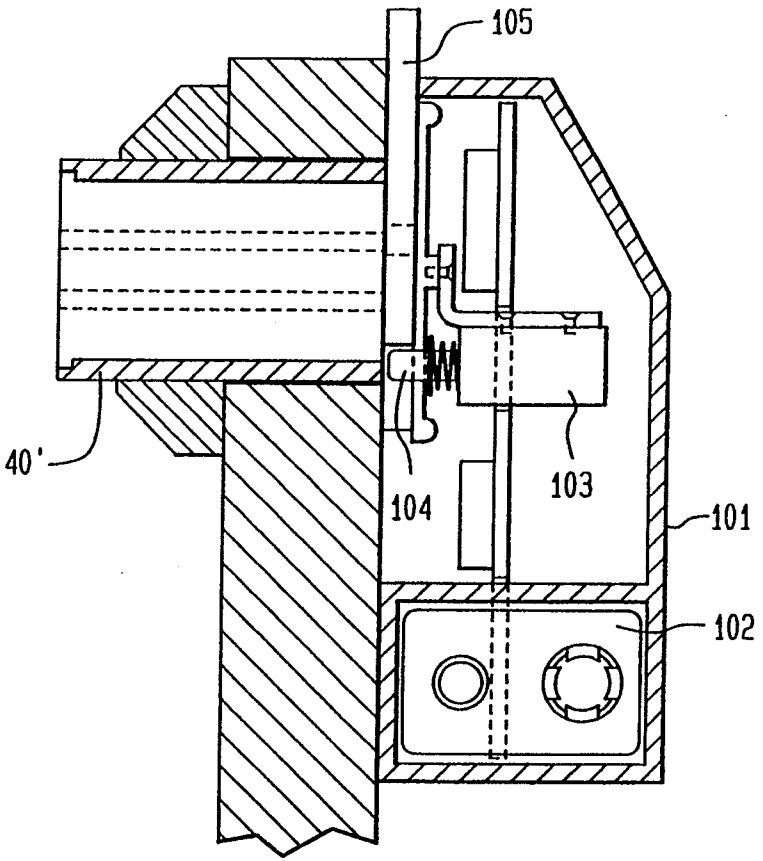
Figure 12A:
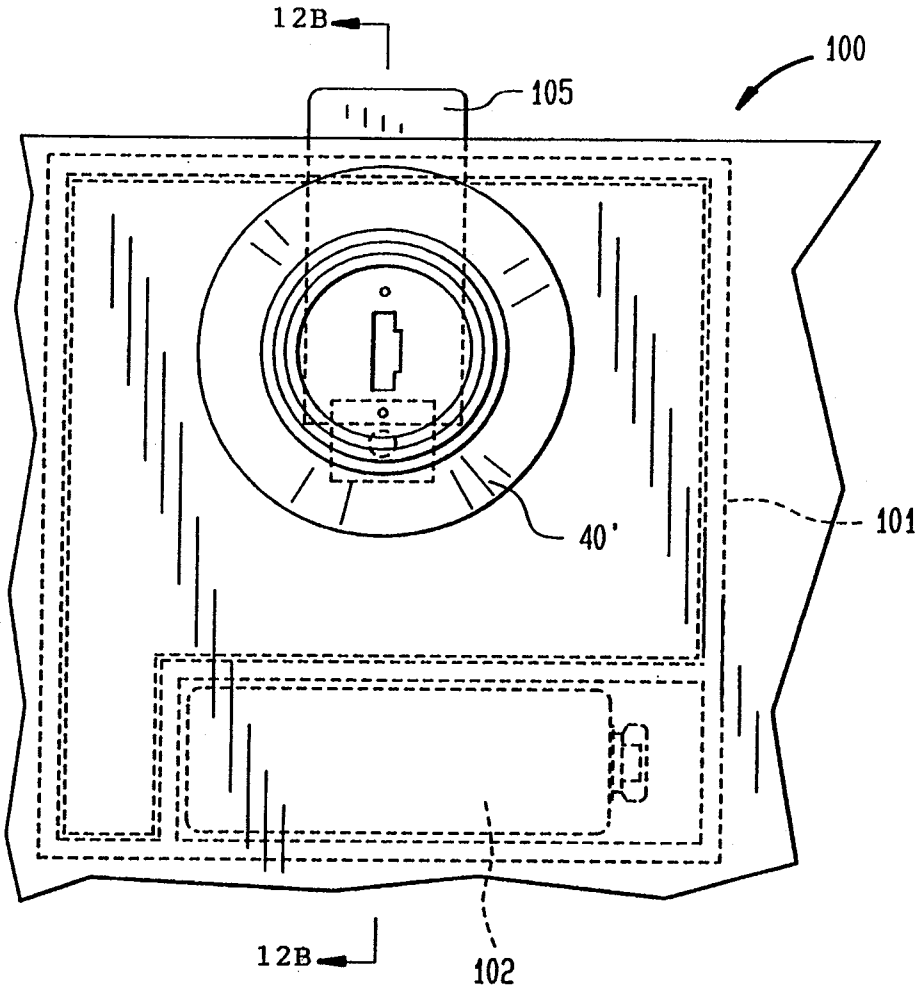
Figure 13A:
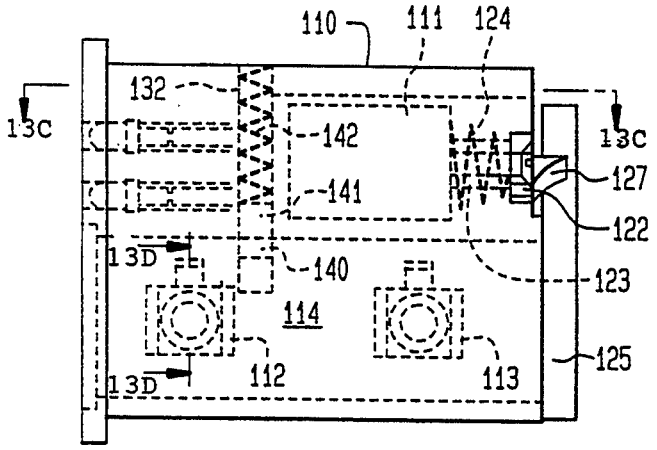
Figure 13B:
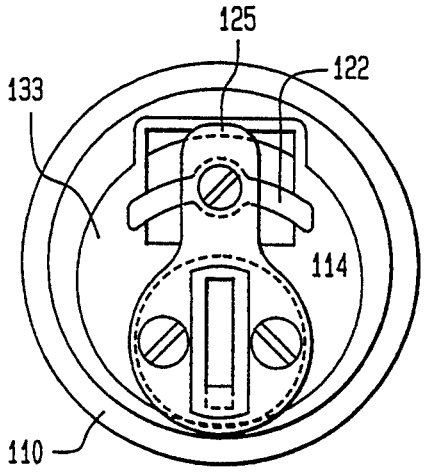
Figure 13C:
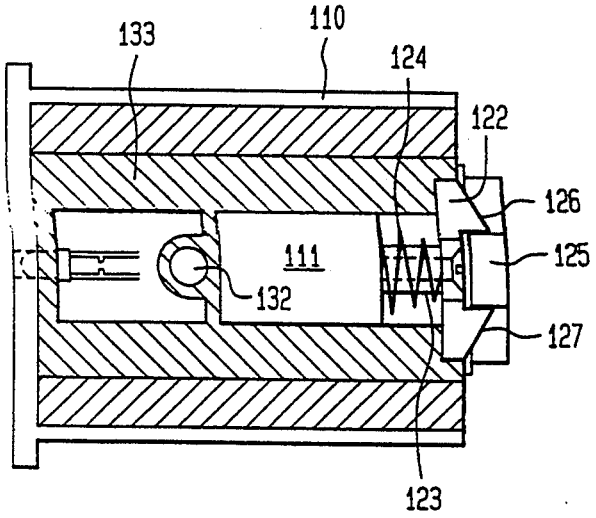
Figure 13D:
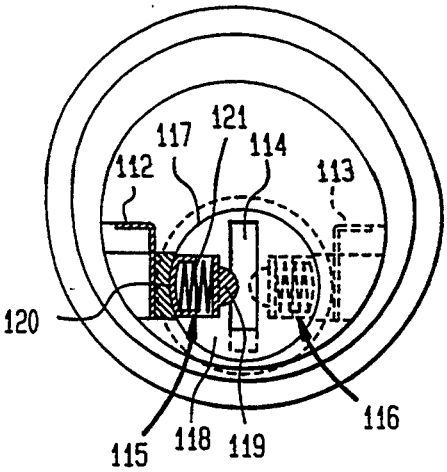
Figure 14A:
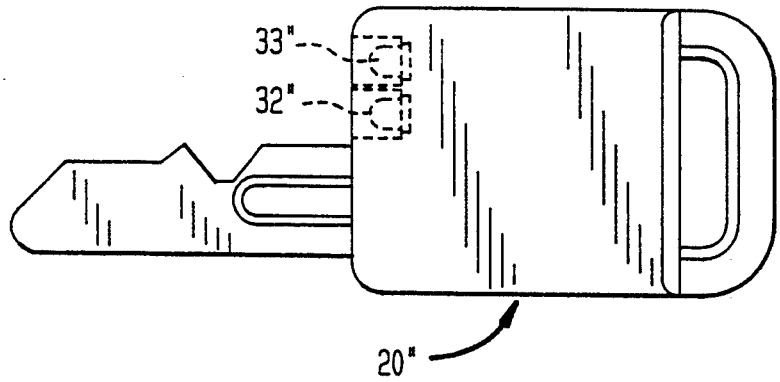
Figure 14B:
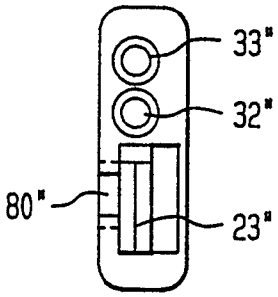
Figure 14C:
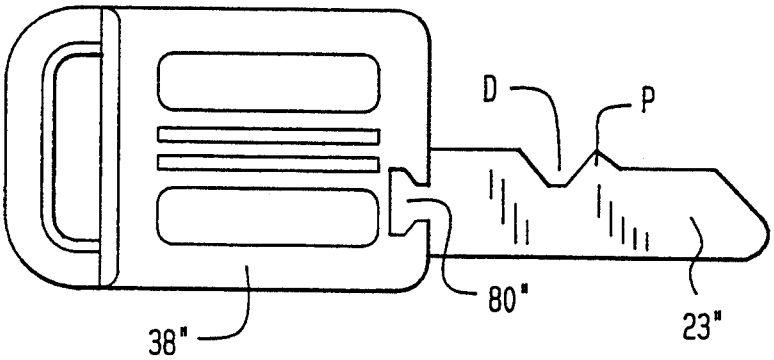
Figure 15A:
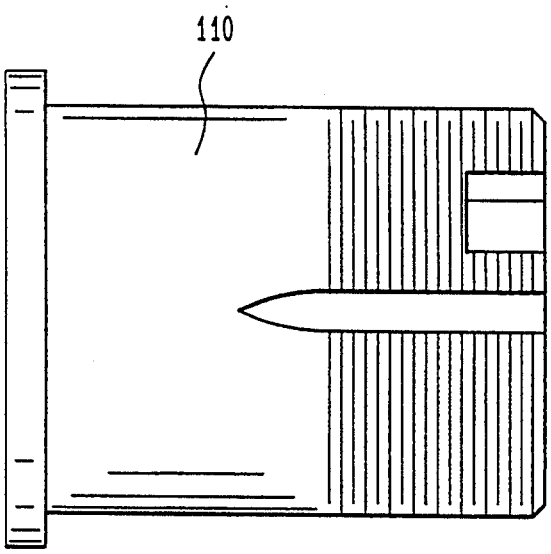
Figure 15B:
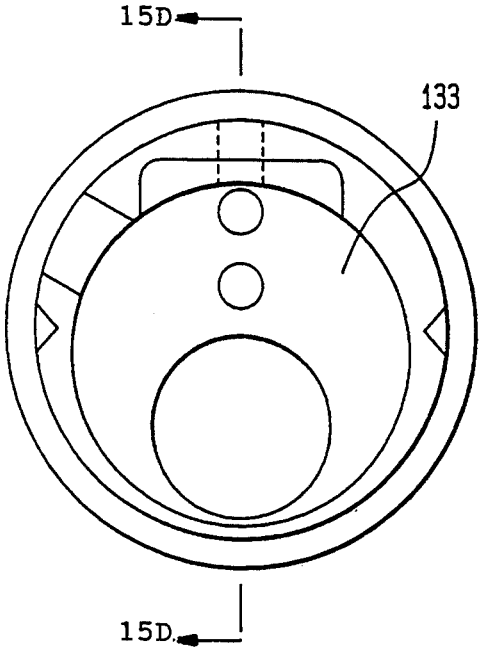
Figure 15C:
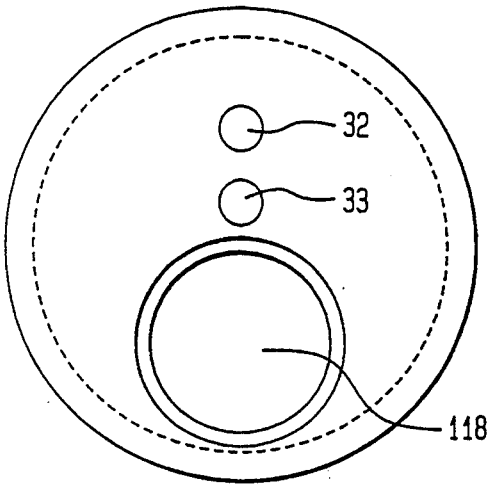
Figure 15D:
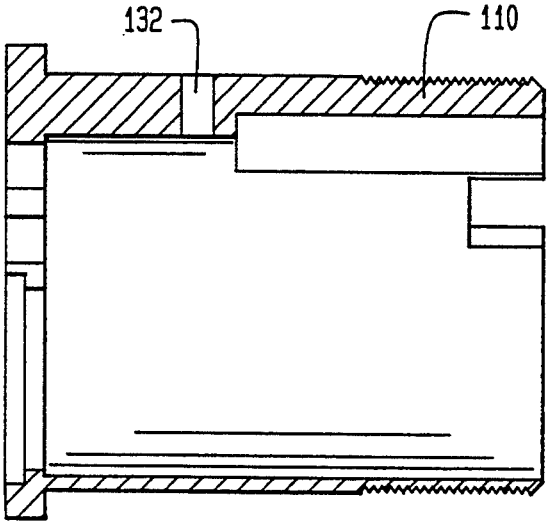
Figure 16A:
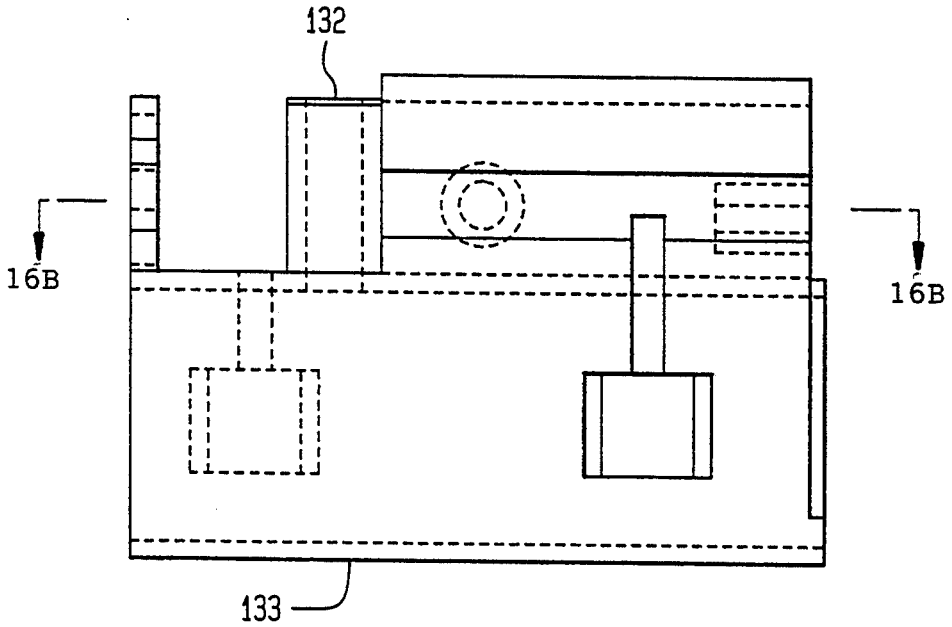
Figure 16B:
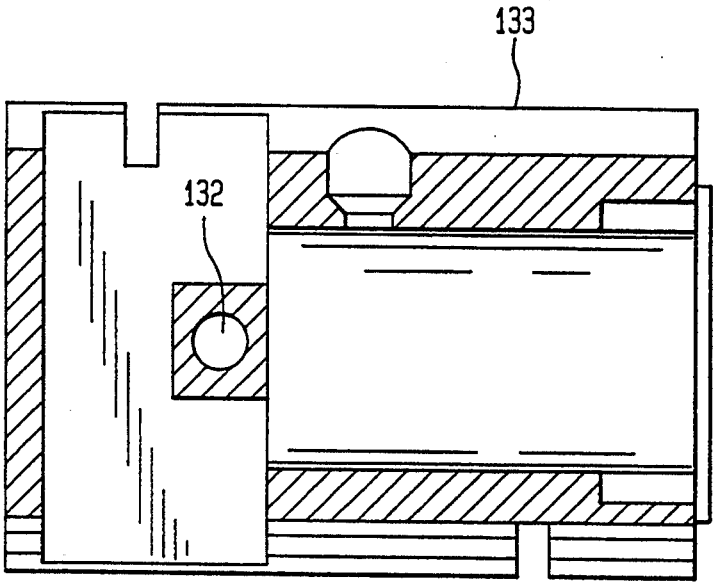
Figure 16C:
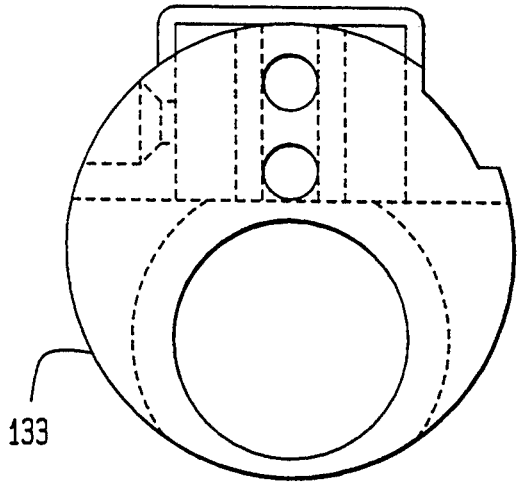
Figure 17A:
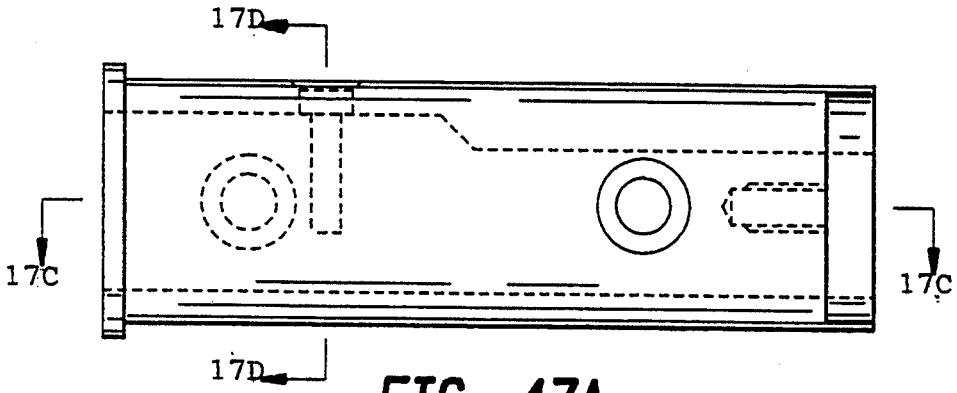
Figure 17C:
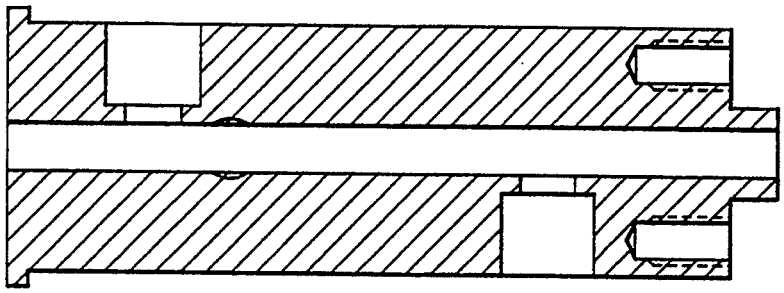
Figure 17B:
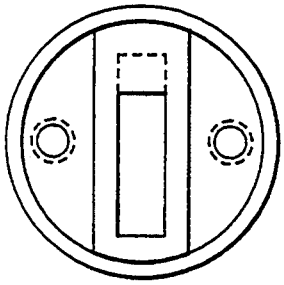
Figure 17D:
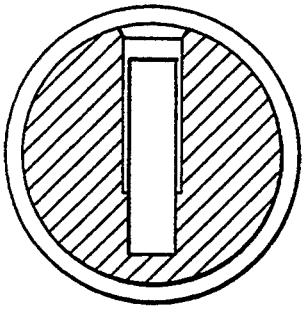
Figure 19A:
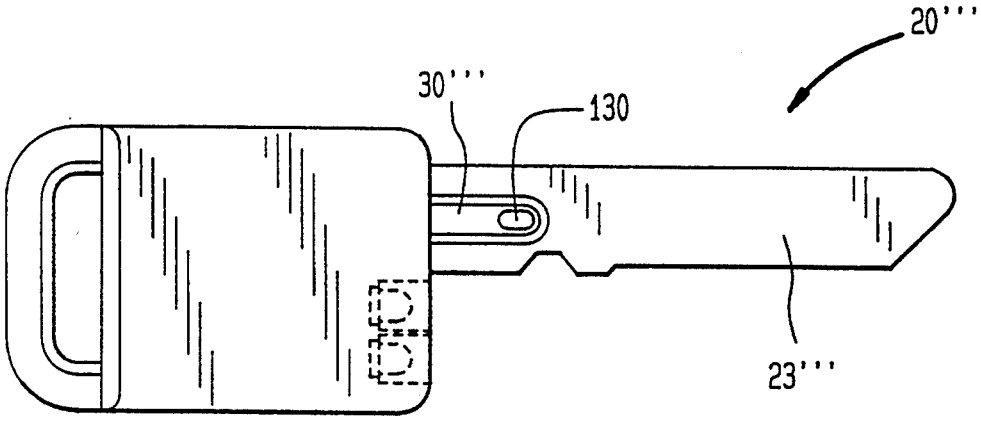
Figure 19B:
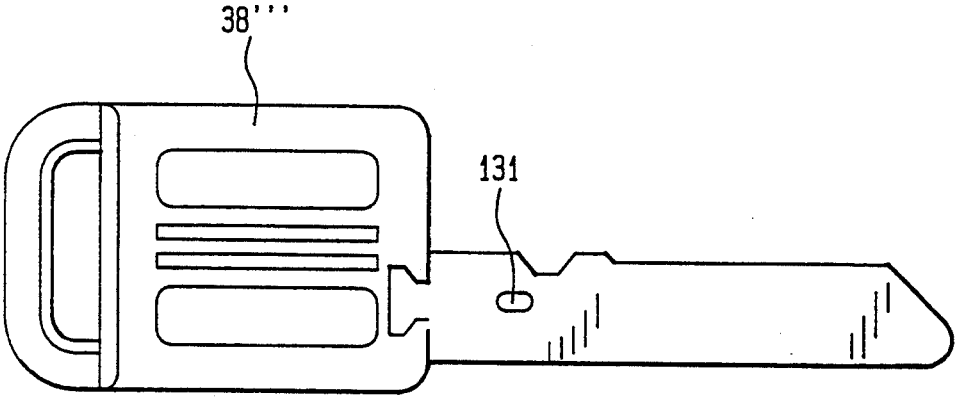
Figure 19C:
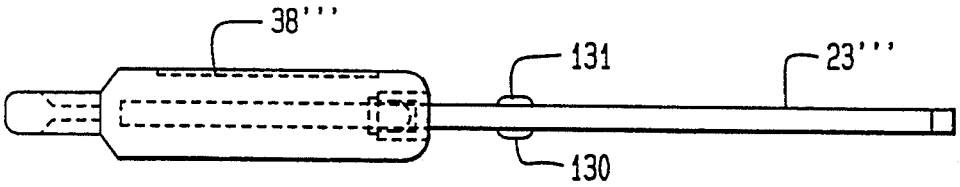
Figure 19D:
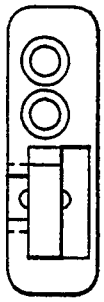
Figure 20:
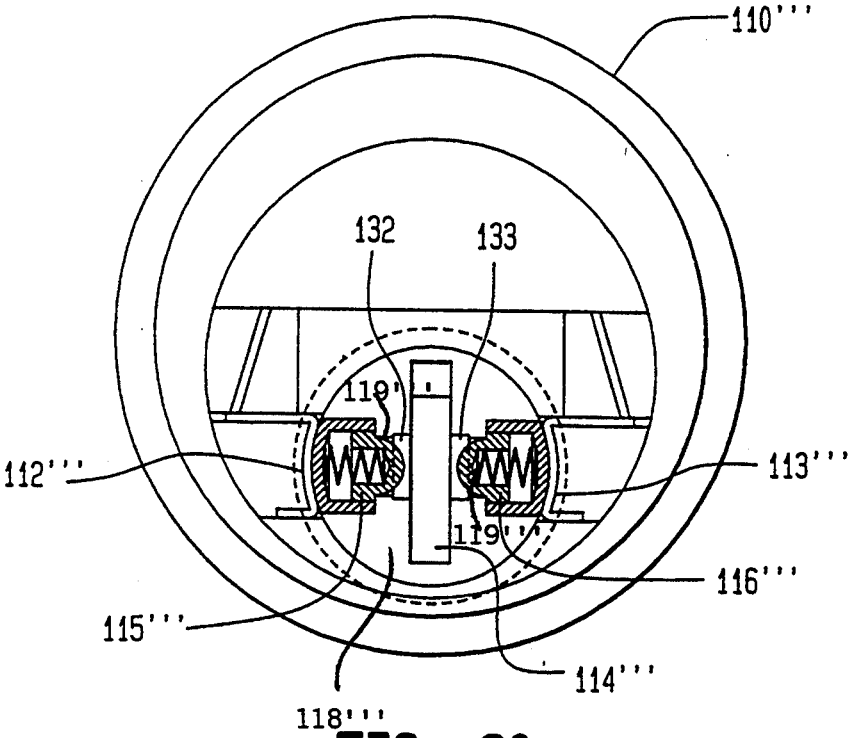

FIG. A is a side view of another embodiment of the electronic key having a raised positive contact so as to provide mechanical polarization;

FIG. 7B is a sectional view taken along lines 7B—7B of FIG. 7A;

FIG. 8 is a schematic perspective view of a molding apparatus for molding an electronic key in accordance with the present invention;

FIGS. 9A and 9B, are, respectively, an end and side view of an external power clip for use with the key illustrated in FIGS. 6A–6C;

FIG. 10A is an elevational view of one side of the electronic cylinder shown in FIG. 1;

FIG. 10B is a sectional view taken along line 10B—10B of FIG. 10A;

FIG. 10C is an elevational view of the other side of the assembly shown in FIGS. 10A and 10B;

FIGS. 10D–10F are, respectively, front, rear and bottom views of the assembly shown in FIGS. 10A and 10C:

FIG. 10G is a sectional view taken along line 10G—10G of FIG. 10B;

FIGS. 11A and 11B are, respectively, end and side views of an electronic cylinder according to another embodiment of the present invention used with the electronic key having a raised positive contact as shown in FIGS. 7A and 7B, but with other parts similar to the lock assembly of FIGS. 10A–10G not illustrated;

FIG. 11C is a sectional view taken along line 11C—11C in FIG. 11B;

FIG. 12A is a front view of the key and lock cylinder system shown in FIGS. 7A and 7B, and 11A–11C applied as a cabinet lock;

FIG. 12B is a sectional view taken along line 12B—12B of FIG. 12A;

FIGS. 13A and B are, respectively, side and rear end views of an electronic cylinder according to another embodiment of the present invention;

FIG. 13C is a cross-sectional view taken along line 13C—13C of FIG. 13A;

FIG. 13D is a front end view of the electronic cylinder taken in partial cross-section of the forward contact seat along line 13D—13D of FIG. 13A;

FIGS. 14A–14C are, respectively, front, front end and back views of the electronic key with flush positive contact shown being molded in FIG. 8 and used with the electronic cylinder of FIGS. 13A–13D;

FIGS. 15A–15C are, respectively, side, rear end and front end views of the standard cylinder body which accommodates the electronic cylinder of FIGS. 13A–13D;

FIG. 15D is a cross-sectional view taken along line 15D—15D of FIG. 15B;

FIG. 16A is a side view of the solenoid housing used in the electronic cylinder of FIGS. 13A–13D;

FIG. 16B is a cross-sectional view taken along line 16B—16B of FIG. 16A;

FIG. 16C is a front end view of the solenoid housing shown in FIG. 16A;

FIGS. 17A and 17B are, respectively, side and rear end views of the key receptacle used in the electronic cylinder of FIGS. 13A–13D;

FIG. 17C is a cross-sectional view taken along line 17C—17C of FIG. 17A;

FIG. 17D is a cross-sectional view taken along line 17D—17D of FIG. 17A;

FIG. 18A is a plan view of a rose for a door knob which accommodates the lock electronics in accordance with another embodiment of the present invention;

FIG. 18B is a cross-sectional view along line 18B—18B of FIG. 18A;

FIG. 19A–19D are, respectively, front side (positive contact), rear side, top and front end views of another embodiment of the key of the present invention serving as a mechanical and electrical key; and FIG. 20 is a front and rear view of another embodiment of an electronic cylinder similar to FIGS. 13A–13D, but with a modified contact and keyway arrangement.

DETAILED DESCRIPTION OF THE DRAWINGS

Referring now to FIG. 1, there are shown the basic components of the system, designated generally by the numeral 10 in an exploded view, for use with a mortise lock. In particular, the system comprises an electronic key designated generally by the numeral 20, and electronic cylinder designated generally by the numeral 40, and an enclosure designated generally by the numeral 60 containing a power supply 61 such as a 9 volt battery, the lock electronics 62 which has been described in the above cross-referenced related application filed on even date, and a connector 63 for connecting the battery power supply 61 to the electronics 62. The details of the structure and function of the lock electronics 62 will thus be dispensed with here.

The system 10 is typically used in a door 11, e.g., a hotel guest room door, which has a slot 12 for a standard mortise lock 13 having an electrically actuated solenoid 14 for effecting locking and unlocking. The electronic cylinder 40 is secured in an aperture 15 drilled or bored through the door 11 above the front door handle 16 in the illustrated embodiment. It will be understood, of course, that in the assembled condition of the system 10, the mortise lock 13 will be inserted in the slot 12 of the door 11 and the enclosure 60 securely attached to the back of the door 11 before the front handle 16 and a rear door handle 17 are connected through the system components so as to move the bolt assembly 18 of the mortise lock 13 through which the handle 16, 17 are connected in a known manner through a square aperture, when a retractable pin 19 of the solenoid 14 is retracted by the insertion of the proper electronic key 20 in the electronic cylinder 40.

Figure 2A:
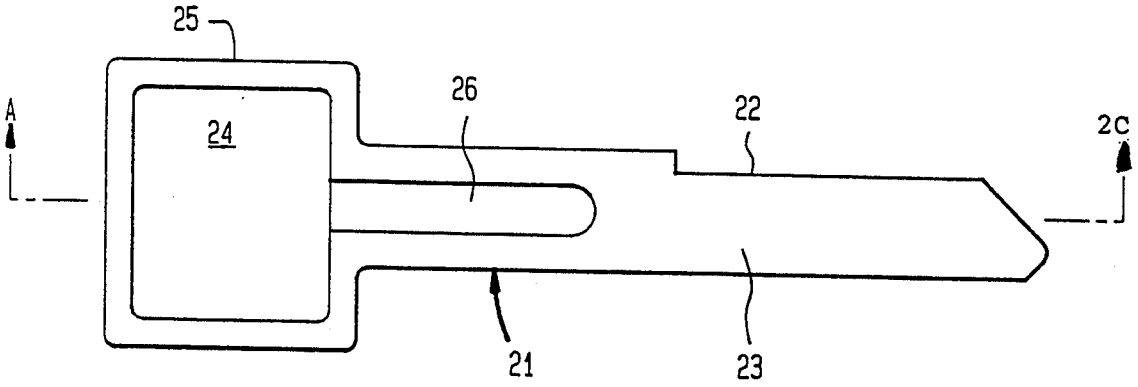
FIGS. 2A–2C are, respectively, a plan view, a side view and a sectional view along line 2C—2C of FIG. 2A of a key blank having a flush contact for the system shown in FIG. 1.
Figure 2B:
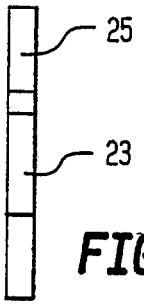
Figure 2C:
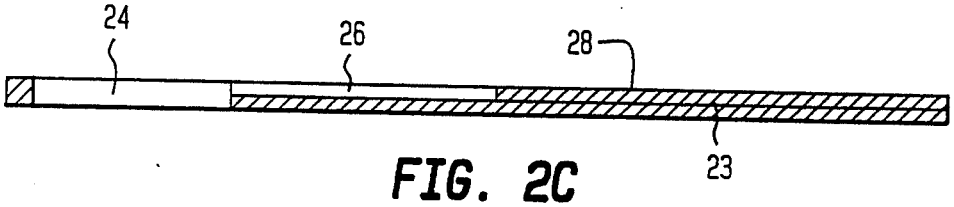
Figure 2D:
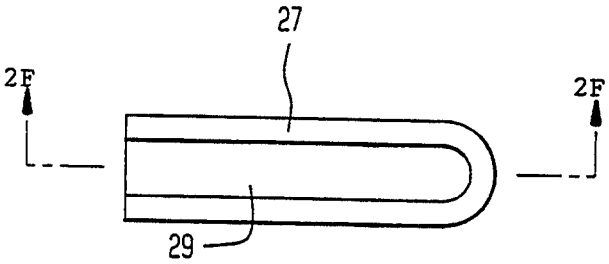
FIGS. 2D–2F are, respectively, a plan view, a side view and a sectional view along line 2F—2F of FIG. 2D, of a contact seat for the key blank shown in FIGS. 2A–2C.
Figure 2E:
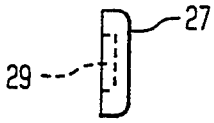
Figure 2F:
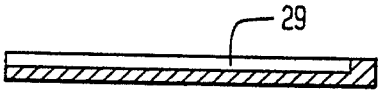

The details of the electronic key 20 and how it is constructed are now described. In one embodiment of the electronic key which is intended to operate the lock totally electronically, i.e., without any mechanical locking capability, a key blank 21 shown in FIGS. 2A–2C made, for example, of leaded nickel silver alloy or other suitable material so as to be conductive, is provided with an outer configuration 22 on the key blade 23 adapted for the electronic cylinder 40 shown in FIG. 1. The key blank 21 has a generally rectangular aperture 24 provided at the end 25 formed as a knob or handle and sized to be grasped by the person using the key. An oblong shallow recess 26 is provided in the blade 23 adjacent the knob end 25 to receive an insulating contact seat 27, as shown in FIGS. 2D–2F, made of polycarbonate or other suitable insulating material.

Figure 3A:
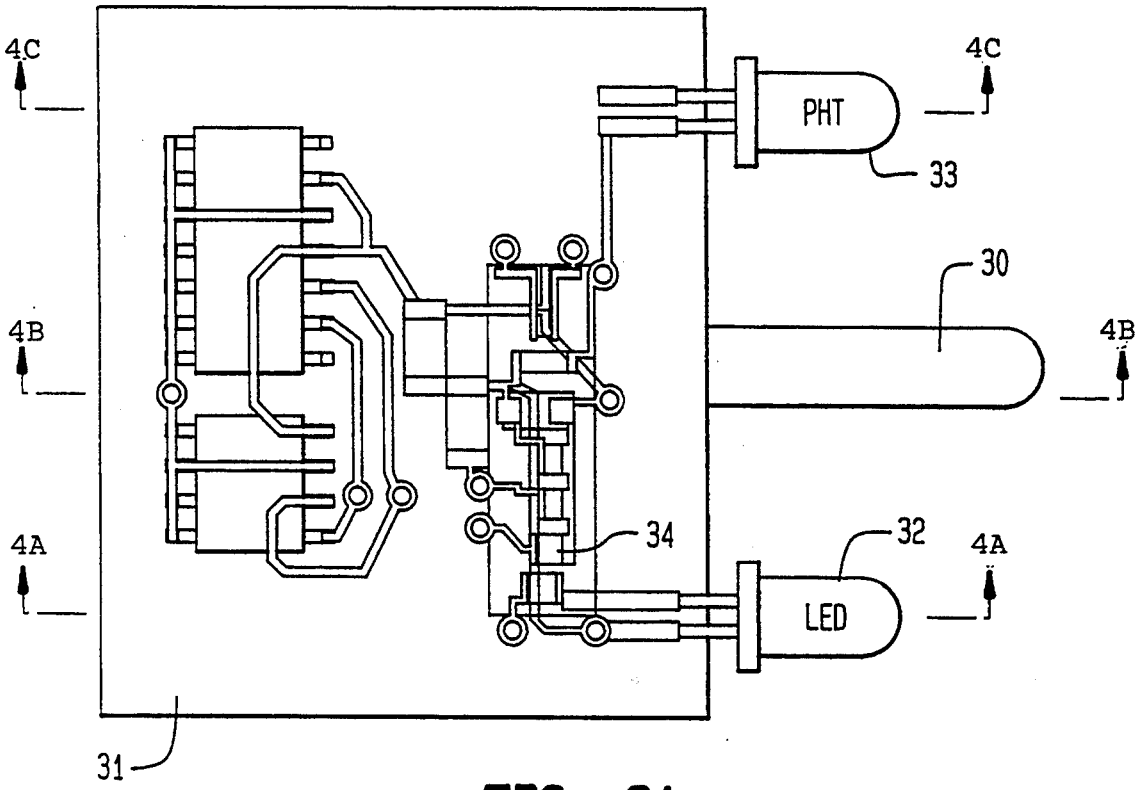
FIGS. 3A and 3B are, respectively, top and bottom views of a printed circuit board (PCB) containing the electronics package, the IR devices and the contact bar inserted in the key knob or handle for powering the electronic key when it is inserted in the cylinder shown in FIG. 1.
Figure 3B:
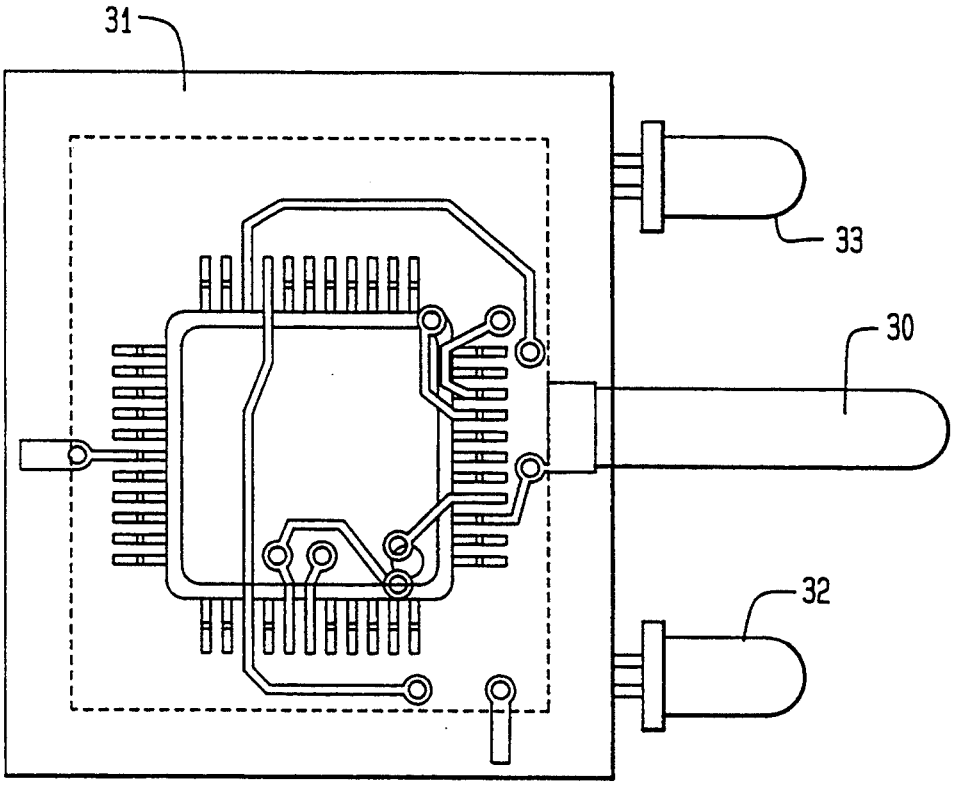
Figure 4A:
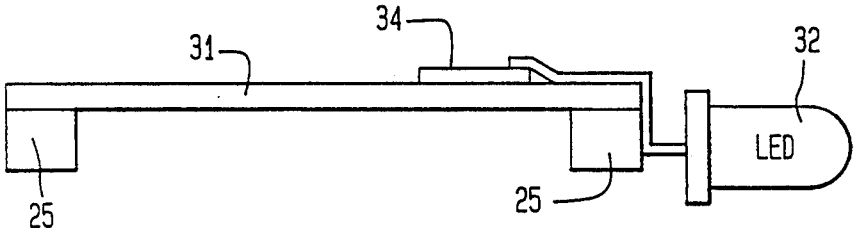
FIGS. 4A–4C are, respective, sectional views taken along lines 4A—4A, 4B—4B and 4C—4C of FIG. 3A showing the general elevational contours of the PCB.
Figure 4B:
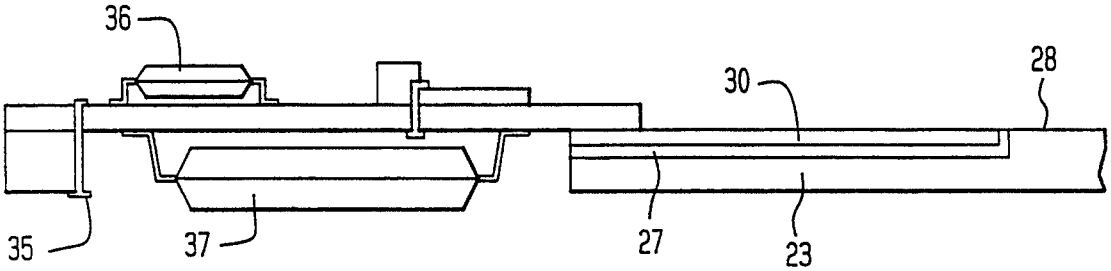

Although not shown to scale in the drawings, it will be understood that the contact seat 27 is sized and configured to fit precisely in the recess 26 on the blade 23 so as to be flush with the top surface 28 of the blade 23. The contact seat 27 can be joined to the key blade 23 by a suitable commercially available adhesive or the like. The contact seat 27 itself has a shallow recessed portion 29 which is similar in shape to the perimeter of the seat 27. A contact bar 30 shown, for example, in FIGS. 3A and 3B also made of suitable conducting material such as copper, is sized and configured to mate with and to be held securely in the recess 29 in the seat 27 by suitable adhesive material, e.g., Loctite 401 adhesive, or the like and also be flush with the top surface 28 as shown in FIG. 4B.

Figure 4C:
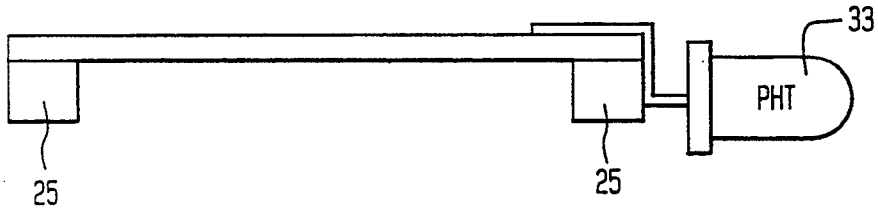

The electronics arranged on a printed circuit board 31 (PCB) for the key 20 are located at the widened end 25 of the key blank 21. The general arrangement of the PCB 31 with the electronics, two commercially available IR devices in the form of a light emitting diode 32 and a photo detector 33 and the contact bar 30 soldered to a bus for the electronics package are shown in FIGS. 3A and 3B before the PCB 31 is assembled with the key blank 21 of FIGS. 2A–2C. By way of general discussion, however, the PCB 31 has a ceramic substrate 34, a ground pin 35, an EE PROM 36 and a lead QFP (micro) 37, as shown in more detail in FIGS. 4A–4C. The actual details of structure and operation of the electronics package are fully described in the cross-referenced related application.

Figure 5A:
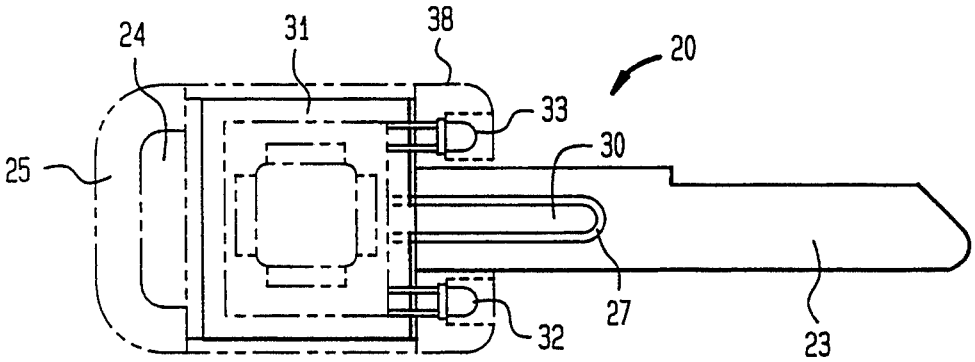
FIGS. 5A and 5B are, respectively, plan and side views of the fully assembled electronic key with a general outline of a molded plastic housing shown in phantom lines to illustrate how the PCB of FIGS. 3A and 3B are assembled in the key knob.
Figure 5B:
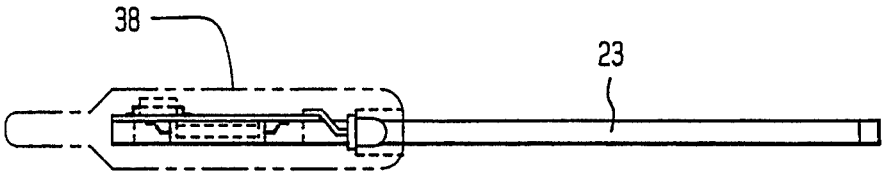

The assembled electronic key 20 is shown in FIGS. 5A and 5B, wherein the PCB 31 has been Joined to the end 25 to leave an opening 24 exposed for passing a key ring or chain therethrough. A plastic housing 38 shown in phantom lines is molded around the PCB 31 and the IR devices 32, 33 which are located in this embodiment, on each side of the blade 23.

Figure 6D:
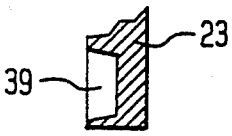
FIG. 6D is a sectional view of a blind hole in the key blade along line 6D—6D of FIG. 6A, the purpose of which is to receive a rider pin.

The finished electronic key is shown in FIGS. 6A–6C. In particular, the key blade 23 has a blind hole 39 (FIG. 6D) drilled or otherwise machined therein below both the positive contact 30 and the insulator seat 27 and rearwardly of the end of the contact 30 (as viewed in FIG. 6A in the direction of key insertion) to permit a sliding contact to touch the positive contact 30 at the desired time during key insertion, in a manner described more fully hereinbelow with reference to FIG. 10B, by a rider pin mating with the blind hole 39. A slot 80 is molded into in the plastic housing 38 on the side of the key blade 23 opposite the blind hole 39, as shown in FIG. 6B, and is configured with a narrower opening at the front edge of the housing 38 so as to accept a mating terminal of an external power clip 81 shown in FIGS. 9A and 9B, as will be more fully hereinafter described. The holes in the housing 38 in which the IR devices 32, 33 are located can be filled, after a molding operation described below with reference to FIG. 8, with a protective material, such as Norland ultra-violet curing optical adhesive or IR sensitive plastic caps. Windows can be provided on the sides of the housing to insert or contain data, such as room number or key number. The positive contact 30 which is secured by adhesive in the insulator seat 27 is also held in place by the molded plastic housing 38 so as to ensure a fully hermetic seal of the electronics package inside the plastic housing 38.

FIGS. 7A and 7B illustrate another embodiment of the electronic key in which similar parts are designated by the same numerals used in FIGS. 6A–6C but with primes. The basic difference between this embodiment and the above described embodiment is that the key 20' has a raised positive contact 30', instead of a flush contact 30, which is adapted to engage a mating slot in the electronic cylinder 40 as shown in FIG. 11A–11C. Due to this arrangement, the blind hole 39 on the key blade is dispensed with. Since only one side of the cylinder 40' has a slot which mates with the raised contact 30', the key 20' can only be fully inserted in one orientation so as to provide a "mechanical polarization." The raised contact 30' can be soldered directly on an extension portion of the PCB 31' which can also form the insulator seat 27' and thus save the need for an additional part and an additional assembly operation.

In order to produce a finished electronic key, a molding operation is used as shown in FIG. 8. The embodiment of the key being assembled is described in more detail below with reference to FIGS. 14A–14C. Parts of the key similar to the parts used in the embodiment of FIGS. 6A–6D are designated by the same numerals, but double primed. For present purposes, it is sufficient to note that the two IR devices 32", 33" are both located on the same side of the key blade 23". To carry out the molding operation, the key blade 23" and the PCB 31" are inserted in their proper orientation in the bottom mold half 91 of the mold designated generally by the numeral 90. Then, the slide member 94 having an end 95 with aperture 96 sized and configured to locate and mate snugly with the IR devices 32", 33" on the PCB 31" is moved in the direction of arrow X so as to precisely locate and seal off the two IR devices 32", 33". Upper mold half 92 is then lowered in the direction of arrow 2 to create the desired cavity shape for molding the plastic housing 38" and, at the same time, to seal off the key blade 23" for preventing the intrusion of moisture and dust into the PCB 31". A suitable plastic material is then injected through a port 97 in the back side of mold halves 91, 92 to mold the plastic housing 38" around the key blade 23" and the PCB 31". This molding operation results in a moisture-proof key and avoids the need for a more expensive and less desirable molding operation wherein separate housing parts are formed and then Joined with ultrasonic welding, adhesives or the like. After the slide member 94 is withdrawn to expose the IR devices 32", 33", the resulting cavity at each IR can be filled with the Norland optical adhesive or IR sensitive plastic caps to protect the IR devices from damage without affecting their respective transmissive and receptive characteristics.

As previously mentioned, an external power device can be used with the electronic key 20 of FIGS. 6A–6C. Although the system 10 can be provided with a low-power indicator warning light in the cylinder 40 to allow sufficient time for replacement of the battery 61, there are instances where the battery 61 can fail before replacement. In those instances, the system 10 is inoperable and will not permit access from the outside without an alternative power source. To this end, a battery clip 81 as shown in FIGS. 9A and 9B can be used. The clip 81 has one leg 82 with an inwardly bent contact portion 83 which is configured to have an arcuate protruding bump-like portion 84 which forms an electric connection with positive contact 30 on the key 20. The other leg 85 of the clip 81 has a bent-in contact portion 86 which is sized to fit in the slot 80 in the plastic housing 38 of the key 20 and complete the electric circuit by contacting the conductive key blade 23 which is electrically insulated from the positive contact 30 by the contact seat 27. The width of the slot 80 is such that the positive contact 83 will not enter the slot 80, i.e., it is form precluded or mechanically polarized so that the portion 84 will not touch the key blade to cause a reversal of polarity. The legs 82, 85 are Joined to an insulator piece 87 which is connected to a battery (not shown) through positive and negative clip terminals 88, 89, respectively.

Reference will now be made to the details of the electronic cylinder 40, shown in FIGS. 10A-10G used with the key 20 shown in FIGS. 6A–6C. The cylinder 40 comprises a housing 41 of roughly cylindrical outline which is sized to fit inside a standard cylinder body used for the mortise lock 13. The assembly 41 can be made of, for example, a suitable plastic material. It has two recesses 42, 43 at respective sides for accommodating a leaf spring contact arms 44, 44' of identical construction on each side. The contact arms 44, 44' have U-shaped end portions 45 which are adapted to be press-fit into the recesses 42, 43. The other ends of the contact arms 44 have inward bent portions 46 which are located for movement within respective larger recess 47, 48 and contain generally rounded contact portions 49 which, in the relaxed or unbiased state, extend into a keyway 50 extending axially through the housing 41. In addition, one of the contact arms 44 is provided with a rider pin 51 made of Teflon or similar low friction, insulating material which extends farther into the axial keyway 50 than its adjoining contact pin 49 so as to prevent that contact pin 49 from contacting the key blade 23 until the rider pin 51 is biased back into the blind hole 39 to allow the associate contact pin 49 to form an electrical contact with the positive contact 30 on the key 20 shown in FIGS. 6A–6C. The rider pin 51 is inserted into a hole 57' in the contact arm 44', as shown in FIG. 10C (also shown at 57 in contact arm 44 in FIG. 10A) and is melted to flatten the head to secure the rider pin on the arm 44'.

A stainless steel face place 52 is used to cover the plastic housing 41 and is secured to the latter, prior to insertion of the housing 41 into the standard cylinder body, by stainless steel legs 53, 54 which are bent around an inner face 55 of the housing 41. The face plate 52, shown more clearly in FIG. 10D, has three apertures for the two IR devices 32, 33 and a low battery warning light LB and a rectangular slot which coincides with the axial passageway 50 in the assembly for receiving the key 20. It will be seen in FIG. 10F that the IR devices are snap fitted in the assembly in a known manner without the need for soldering or the like to hold them securely in place. Furthermore, wires for the contacts 44 and the IR's 32, 33 and LB can also be assembled thereto by snap fittings rather than by more costly joining techniques. A six-pin male connector housing 56 to which the IR and contact leads 10 are connected is provided at the rear of the housing 41 to mate with a female connector on a wire 98 from the lock electronics package 62 in the enclosure 60 shown in FIG. 1.

FIGS. 11A-11C show the cylinder assembly 40' for a key with a raised positive contact 30' of the type shown in FIG. 7A. The face plate 52' and passageway 50' are configured to mate with the cross-section of the key blade 23', including the raised contact portion 30'. It will thus be appreciated that the key 20' can be inserted all the way through the passageway 50' if it is the proper key, only if it is oriented correctly since otherwise the raised contact 30' will prevent passage of the key 20' all the way into the keyway 50' and thus prevent contact between the contact pin 49' and the raised contact 30'. In other words, this form-precluding feature provides mechanical polarization which precludes insertion of the key incorrectly into the lock cylinder and thus assures proper contact with the leg spring contact arms 44'.

The cabinet lock 100 shown in FIG. 12A and 12B includes a plastic housing 101 which holds the lock electronics in a manner similar to the enclosure 60 of FIG. 1. It is a one-piece assembly which also includes a battery 102. The cylinder 40' of the type shown in FIGS. 11A–11C can be attached through a bore in the cabinet door or drawer. A solenoid 103 is attached to a plate in the housing 101 and has a spring biased pin 104 which retracts from a pivotable lever 105 to allow opening and closing of the cabinet door or drawer. When the solenoid pin 104 is withdrawn, the keyway 50' can turn by mechanical action of the inserted key 20' to turn the lever.

The present invention is also applicable to electronic cylindrical locks of the type shown in FIGS. 13A–13D which is used with the type of electronic key 20" shown in FIGS. 14A–14C in which both IR devices 32", 33" are on the same side of the key blade. The cylinder comprises a body 110 made of brass or the like, a solenoid 111 fixed in a solenoid housing 133, fixed brass contacts 112, 113 disposed on each side of the keyway 114 on appropriately configured recesses in the body 110, spring-biased contacts 115, 116 associated respectively with the fixed contacts 112, 113. The faces of the fixed contacts 112, 113 have a concave circular shape so as to constitute a portion of the circular surface 117 of the cylinder plug 118 (shown in FIGS. 17A–17D) inserted in the body 110 offset from the axial center thereof. The fixed contacts 112, 113 have an L-shaped portion, as best seen in FIG. 13D, which is connected to a lead wire to the lock electronics in a manner, e.g., snap fitted, similar to the system connectors previously described.

The movable contacts 115, 116 are identically constructed and include a brass contact portion 119 and a movable brass cap 120 held in appropriately configured recesses in the cylinder plug 118. The cap 120 has a convex circular surface with the same radius as the surface 117 so as to make contact with the mating face of the fixed contacts 112, 113 as the cylinder plug 118 is rotated after insertion into the keyway 114 of the proper key which communicates with the lock electronics in the manner described in the above-referenced related U.S. patent application. The contact portion 119 is biased outwardly toward the keyway 114 by a spring 121 so as to assure positive contact.

The cylinder also includes a cam locator 122 which is connected to the solenoid 111 through an axially movable solenoid pin 123 so that as the lock electronics actuates the solenoid 111 to move the pin 123 against the bias of compression spring 124, the cam 125 fixed at the rear end of the cylinder plug 118, can be rotated by rotation of the cylinder plug 118 upon actuation of the lock electronics. The cam surfaces 126, 127 on the cam locator 122 permit the cam 125 to be moved back into the locking position from either direction after the solenoid 111 is deactuated by removal of the key and the cam locator 122 has been returned to its axially extended position under the bias of spring 124. A bracket (not shown) limits the movement of the locator 122 and pin 124 outward so as to return an operative relationship between the surfaces 126, 127 and the lever 125.

The cylinder plug 118 has the keyway 114 and the recesses for the movable contacts comprised of the contacts 119, caps 120 and spring 121. The cylinder plug 118 and housing 133 is also provided with a blind bore 132 which communicates with the keyway 114. A plastic solenoid housing 133 (FIGS. 16A–16C) made of, for example, polycarbonate, houses the solenoid 111 and also has a bore which constitutes part of the passageway 132. The solenoid housing 133 is held against rotation in the cylinder body 110 (FIGS. 15A–15D) which has an aperture at the top also constituting a portion of the passageway 132 which communicates with the keyway 114 in the cylinder plug 118 through the bore 132 in the solenoid housing 133.

The cylinder body 110 is held against rotation, i.e., rotatably fixed in the door. The solenoid housing 133, in which the cylinder plug 118, the solenoid 111 and the cam locator 122 have already been assembled, is arranged in the body 110. Now the function of bore 132 disposed transverse to the axis of body 110, solenoid housing 133 and cylinder plug 118 will now be explained. In order to prevent subjecting the cam locator 122 to undesired forces by the action of someone inserting a tool, say a screwdriver, into the keyway 114 and turning the cylinder plug 118, it is necessary to prevent unwanted rotation of the cylinder plug 118 with respect to the solenoid housing 133. In addition, it is desirable to provide only a single orientation of the key 20″ relative to the cylinder plug 118 when the former is to be inserted into and removed from the latter so that the IRs 32″, 33″ on the key 20″ align with complementary IRs in the solenoid housing 133. To this end pins 140, 141 of shorter and longer lengths, stacked one above the other, respectively, are arranged in the bore 132 and biased toward the end of the blind bore 132 in the keyway 114 by a spring 142. The pins 140, 141 are sized such that when the key 20″ has not yet been inserted into the keyway 114, the pin 140 is completely within the cylinder plug 118 and the longer pin 141 bridges the interface between the cylinder 118 and the solenoid housing 133. When the key 20″ has been inserted such that the protrusion P on the key blade 23 has now raised the pin 140 to that interface and pin 141 above the interface and then lower the pin 140 into the V-shaped depression D on the blade (FIG. 14C) so that the pin 141 does not extend beyond the interface, the key 20″ can rotate the cylinder plug 118 relative to the solenoid housing if the key 20″ has been verified as an authorized key and the solenoid pin 123 retracted to permit rotation of the lever 125 and the cylinder plug 118. Due to the axially fixed presence of the pin 140 at the bottom of the bore 132 partially in the keyway 114, however, the key 20″ cannot be withdrawn from the cylinder plug 118 until the bore 132 in the keyway 114 is aligned with the bore 132 in the solenoid housing 133 to allow the pin 140 to be pushed upwardly by the protrusion P on the key blade 23″ against the bias of spring 142 toward the solenoid housing 133 when the key 20″ is being removed from the cylinder and then under the bias of spring 142 back towards the bottom of the blind bore 132 in the cylinder plug 118.

According to another embodiment of the electronic cylinder lock of the type shown in FIGS. 13A–13D in which a key is used to operate both electronically and mechanically, provision is made to prevent serrations on the key blade from damaging or prematurely wearing the movable contacts in the cylinder plugs. This alternate embodiment of the key is shown in FIGS. 19A–19D and the corresponding cylindrical lock is shown in FIG. 20. Parts similar to previously described parts in FIGS. 13A–13D and 14A–14C are identified by the same numerals but triple printed to simplify the discussion and concentrate on the modified features of this embodiment.

To prevent the key blade 23‴ from wearing the contact portion 119‴ in the cylinder 118‴, bumps or dimples 130, 131, respectively, are provided on the positive contact 30‴ and on the key blade 23‴ immediately opposite each other. The bump or dimple 131 can be formed in the blade 23‴ by a known punching operation, e.g., deformation of the key blade material to cause a coining of the metal into the appropriately sized and configured dimple 131.

Similarly, the bump or dimple 130 in the positive contact 30‴ can be formed by a similar mechanical process prior to joining the positive contact 30‴ with the insulating seat 27‴ and molding the housing 38‴ around the PCB and key handle 25‴. Of course, it will be readily understood that many other techniques are available to create protrusions from the key blade and positive contact, and these techniques do not depart from the principles of the present invention.

The contact portions 119‴ in the modified cylinder lock shown in FIG. 20 are recessed slightly rearwardly so as to be outside the perimeter of the keyway 114‴ in the cylinder plug 118‴. Because the dimples 130, 131 on the positive contact 30‴ and key blade 23‴ are directly opposite one another, the movable contacts 115''', 116''' in the plug 118''' are also directly opposite one another rather than axially offset as shown in FIG. 13A. Furthermore, to accommodate the two dimples 130, 131 in the keyway when the key 20''' is inserted, two recesses 132, 133 are provided on each side of the keyway 114''' and are sized sufficiently large to allow passage of the dimples 130, 131 along the key 20''' in the keyway 114''' until the dimples 130, 131 make electrical contact with the movable contacts 115''', 116''', respectively. Thus, unnecessary wear of the contact portion 119''' on the contacts 115''', 116''' is avoided due to the fact that no portion of the key 20''', except the dimples 130, 131, touch the contacts 115''', 116'''.

As an alternate to the enclosure 60 for the electronics package 62 shown in FIG. 1, a more compact package can be obtained by accommodating the electronics in a rose 150 of a door lock (not shown) as shown in FIGS. 18A and 18B. The various components of the electronic package are shown in dotted lines merely as an illustration of how the components are disposed in the annulus of the rose. A bus 151 with lead wires for connecting the intelligence with the cylinder lock will, of course, not be exposed in an actual installation, but will pass through a bore or hole which is covered by the rose 150.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A key for use with an electronic lock system comprising a body having a handle at one end and a blade constituting a first electrical contact at the other end, said handle containing an electronic circuit package electrically connected with said first electrical contact, said blade containing a single second electrical contact extending along a portion of said blade and being electrically insulated from said blade, said single second electrical contact being electrically connected with said electronic circuit package and being configured so as to mechanically polarize said key such that said key may be inserted into a keyway of a lock in only a single orientation, a light emitting device and a light receiving device arranged adjacent to said blade and being operatively connected with said electronic circuit package, and a housing surrounding said electronic circuit package and at least a portion of said handle in a moisture-proof manner.

2. A key according to claim 1, wherein only one said of said blade has light emitting and light receiving devices arranged adjacent thereto.

3. A key according to claim 1, wherein the housing is provided with a shaped element for connecting a terminal of an external power source to the blade such that another terminal of the external power source is prevented from contacting the blade by the shaped element.

4. A key according to claim 1, wherein said electronic circuit package includes an insulating printed circuit board having an extension portion which extends from said housing along said blade, and wherein said single second electrical contact is electrically insulated from said blade by said extension portion of said insulating printed circuit board.

5. A key according to claim 1, wherein said blade includes a recess provided in operative relationship to said second electrical contact so as to preclude electrical engagement by a lock contact element with said blade.

6. An external power source connection arrangement for coupling power from an external power source to an electronic key and lock system comprising:

a first contact leg for providing electrical contact with a first electrical contact element of an electronic key;

a second contact leg for providing electrical contact with an electrically conductive blade of said electronic key;

a connector which is operative to connect said first and second contact legs with a power source external to said lock system and exclusive of an electrical power supply path through said lock system; and a shaped element on one of said contact legs for ensuring proper electrical connection of the contact legs with said electronic key.

7. A cylinder for an electronic key and lock system, comprising:

a housing with a keyway;

a plurality of leaf spring contact arms having portions configured to be press fitted into recesses in the housing at spaced axial positions along the keyway so as to have contact portions extending into the keyway in the absence of an electronic key in the keyway;

an insulating rider pin associated with one of the contact arms arranged to provide an electrical connection with a positive contact of the electronic key, the rider pin extending into the keyway and preventing contact with a conductive blade of the electronic key during insertion of the key into the keyway;

IR devices arranged within the housing so as to operatively operate with IR devices in the electronic key;

a low battery warning light arranged within the housing;

lead wires press-fit connected with the contact arms, IR devices in the housing and the low battery warning light; and means arranged in proximity to an end of the housing remote from an entrance to the keyway for providing a multi-pin connector for connection to an electronic package of a lock system for permitting authorized access to a locked area.

8. The cylinder according to claim 7, wherein a metal face plate is provided at an end of the housing constituting the keyway entrance, the face plate having two legs extending into the housing and each of the legs having an L-shaped portion formed around an internal surface of the housing to prevent removal of the face plate.

9. The cylinder according to claim 8, wherein the housing is plastic.

10. The cylinder according to claim 7, wherein the contact arms have an identical configuration, including means for selectively Joining the rider pin, and the portions configured to be press-fitted into the recesses have a U-shape.

11. The cylinder according to claim 10, wherein a metal face plate is provided at an end of the housing constituting the keyway entrance, the face plate having two legs extending into the housing and each of the legs having an L-shaped portion formed around an internal surface of the housing to prevent removal of the face plate.

12. An electrical cylinder for an electronic key and lock system, comprising:

a solenoid housing adapted to be arranged inside a cylinder body;

a cylinder plug rotatably arranged within the solenoid housing and having a keyway extending axially therethrough;

stationary contacts arranged within the solenoid housing at axially spaced positions;

movable contacts arranged within the cylinder plug and in operative electrical relationship to the stationary contacts of the solenoid housing;

a solenoid in the solenoid housing, said solenoid having a pin with a cam locator normally biased toward a rear portion of the solenoid housing in the absence of an authorized electronic key in the cylinder plug;

a cam fixed at the cylinder plug so as to be engaged by the cam locator in a locked position in the absence of the authorized electronic key in the cylinder plug; and lock electronics and IR devices operatively connected with the lock electronics and the solenoid for actuating the latter in response to the insertion of the authorized electronic key in the cylinder plug.

13. The electronic cylinder according to claim 12, wherein means is provided to prevent rotation of the cylinder plug relative to the housing except by the authorized electronic key and removal of the authorized key except in a specific orientation thereof.

14. The electronic cylinder according to claim 13, wherein the movable contacts are normally spring biased toward the keyway.

15. The electronic cylinder according to claim 13, wherein the stationary and movable contacts have complementary arcuate contact surfaces at an interface between the solenoid housing and the cylinder plug.

16. The electronic cylinder according to claim 13, wherein the cam locator has a central portion for retaining the cam in the locked position and two oppositely sloped surfaces on each side of the central portion for permitting the cam to be moved to the central portion against the biased pin and cam locator.

17. The electronic cylinder according to claim 13, wherein the IR devices are arranged on one side of the cylinder plug.

18. An electronic key and lock system for a solenoid-operated cylinder, comprising:

a key having a handle at one end and a blade constituting an electrical contact at the other end, wherein electronics and associated IR devices are arranged within a housing on the handle and a positive contact operatively connected with the electronics on the handle extends along a portion of the blade with electrical insulation therebetween;

a cylinder body containing a solenoid housing and a cylinder plug with a keyway extending axially therethrough rotatably arranged within the solenoid housing, wherein the solenoid housing has stationary contacts at axially spaced positions and the cylinder plug has movable contacts in operative electrical relationship with the stationary contacts, and further the solenoid housing having a solenoid with a cam locator at the free end of a pin normally biased toward a rear portion of the solenoid housing in the absence in the cylinder plug of the key, which has selectively programmed authorization for access to the system, and IR devices operatively connected with lock electronics, contained in an enclosure, and the solenoid for actuating said solenoid in response to the presence of the authorized key in the cylinder plug, and wherein the cylinder plug has fixed thereto a cam so as to be engageable by the cam locator in a locked position in the absence of the authorized key in the cylinder plug; and said enclosure containing a power source and said lock electronics operatively connected with the stationary contacts, IR devices and with the solenoid for selectively opening and closing a lock.

19. The system according to claim 18, wherein means is provided to prevent rotation of the cylinder plug relative to the housing except by the authorized electronic key and removal of the authorized key except in a specific orientation thereof.

20. The system according to claim 18 wherein the movable contacts are normally spring biased toward the keyway.

21. The system according to claim 20, wherein the stationary and movable contacts have complementary arcuate contact surfaces at an interface between the solenoid housing and the cylinder plug.

22. The system according to claim 21, wherein the cam locator has a central portion for retaining the cam in the locked position and two oppositely sloped surfaces on each side of the central portion for permitting the cam to be moved to the central portion against the biased pin and cam locator.

23. The system according to claim 18, wherein the blade is configured mechanically to operate a lock.

24. The system according to claim 23, wherein the IR devices are arranged on one side of the blade.

25. The system according to claim 24, wherein a recess is provided in the blade in operative relationship to the positive contact to preclude an electrical contact by a positive lock contact with the blade.

26. The system according to claim 25, wherein the electronics on the handle include an insulating printed circuit board which extends between the blade and the positive contact.

27. The system according to claim 18, wherein the enclosure is a thin annular door handle rose having an aperture for a door handle.

28. An electrical cylinder for an electronic key and lock system, comprising:

a solenoid housing adapted to be arranged inside a cylinder body;

a cylinder plug rotatably arranged within the solenoid housing and having a keyway extending axially therethrough with recesses arranged along each side of the keyway;

stationary contacts arranged within the solenoid housing at directly opposite sides of the keyway;

movable contacts arranged directly opposite each other within the cylinder plug and in operative electrical relationship to the stationary contacts of the solenoid housing;

a solenoid in the solenoid housing; the solenoid having a pin with a cam locator normally biased toward a rear portion of the solenoid housing in the absence of an authorized electronic key in the cylinder plug;

a cam fixed at the cylinder plug so as to be engaged by the cam locator in a locked position in the absence of the authorized electronic key in the cylinder plug; and lock electronics and IR devices operatively connected with the lock electronics and the solenoid for actuating the latter in response the insertion of the authorized electronic key in the cylinder plug.

29. An electronic key and lock system for a solenoid-operated cylinder, comprising:

a key having a handle at one end and a blade constituting an electrical contact at the other end, wherein electronics and associated IR devices are arranged within a housing on the handle and a positive contact operatively connected with the electronics on the handle extends along a portion of the blade with electrical insulation therebetween, and a first protrusion extends from the positive contact and a second protrusion extends from the blade;

a cylinder body containing a solenoid housing and a cylinder plug with a keyway and recesses arranged laterally thereof for accommodating the first and second protrusions on the key extending axially therethrough rotatably arranged within the solenoid housing, wherein the solenoid housing has oppositely disposed stationary contacts and the cylinder plug has oppositely disposed movable contacts in operative electrical relationship with the stationary contacts, and further the solenoid housing having a solenoid with a cam locator at the free end of a pin normally biased toward a rear portion of the solenoid housing in the absence in the cylinder plug of the key which has selectively programmed authorization for access to the system and IR devices operatively connected with lock electronics, contained in an enclosure, and the solenoid for actuating said solenoid in response to the presence of the authorized key in the cylinder plug, and wherein the cylinder plug has fixed thereto a cam so as to be engagable by the cam locator in a locked position in the absence of the authorized key in the cylinder plug; and said enclosure containing a power source and said lock electronics operatively connected with the stationary contacts, IR devices and with the solenoid for selectively opening and closing a lock.

30. An electronic key and lock system for a solenoid-operated cylinder comprising:

a key having a handle at one end and a blade constituting a first electrical contact at the other end, said handle containing an electronic circuit package electrically connected with said first electrical contact, said blade containing a single second electrical contact extending along a portion of said blade and being electrically insulated from said blade, said single second electrical contact being electrically connected with said electronic circuit package and being configured so as to mechanically polarize said key such that said key may be inserted into a keyway of a lock in only a single orientation, a light emitting device and a light receiving device arranged adjacent to said blade and being operatively connected with said electronic circuit package;

a cylinder having a keyway with axially spaced contacts therein for contacting respectively the key blade and the second electrical contact of said key, said cylinder having respective light receiving and light emitting devices arranged to communicate with the light emitting and light receiving devices of said key; and an enclosure containing a power source and an electronic lock circuit arranged to be electrically connected with the spaced contacts of said cylinder and with said solenoid-operated cylinder.

31. The system according to claim 30, wherein said second electrical contact is flush with a surface of the blade and a recess is provided in the blade in relationship to said second electrical contact to prevent contact of more than one of the contacts in the cylinder with the blade.

32. The system according to claim 31, wherein the handle is provided with shaped means for connecting a terminal of an external power source to the blade such that another terminal of the external power source is prevented from contacting the blade by the shaped means.

33. The system according to claim 30, wherein the spaced contacts are leaf spring contact arms having U-shaped portions press-fitted into recesses in the cylinder, and an insulating rider pin is associated with one of the arms arranged to provide an electrical contact with the second contact of the key, the rider pin extending into the keyway and preventing contact of the associated contact arm with the blade.

34. The system according to claim 30, wherein only one side of said blade has light emitting and light receiving devices arranged adjacent thereto.

35. The system according to claim 30, wherein said electronic circuit package includes an insulating printed circuit board having an extension portion which extends from said handle along said blade, and wherein said single second electrical contact is electrically insulated from said blade by said extension portion of said insulating printed circuit board.

36. The system according to claim 30, wherein said enclosure comprises a thin annular member having a central aperture for a door handle, said enclosure containing a power source and said electronic lock circuit, which includes a microcontroller which controls the operation of said electronic lock circuit.

* * * * *